US009116448B2

(12) United States Patent
Terauchi et al.

(10) Patent No.: US 9,116,448 B2
(45) Date of Patent: Aug. 25, 2015

(54) TONER

(71) Applicant: CANON KABUSHIKI KAISHA, Tokyo (JP)

(72) Inventors: Kazuo Terauchi, Numazu (JP); Shuhei Moribe, Mishima (JP); Kosuke Fukudome, Tokyo (JP); Satoshi Mita, Mishima (JP); Yojiro Hotta, Mishima (JP); Tetsuya Ida, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 13/922,205

(22) Filed: Jun. 19, 2013

(65) Prior Publication Data

US 2013/0344430 A1 Dec. 26, 2013

(30) Foreign Application Priority Data

Jun. 22, 2012 (JP) ..... 2012-141035

(51) Int. Cl.
*G03G 9/00* (2006.01)
*G03G 9/087* (2006.01)

(52) U.S. Cl.
CPC ..... *G03G 9/08755* (2013.01); *G03G 9/08704* (2013.01); *G03G 9/08711* (2013.01); *G03G 9/08728* (2013.01); *G03G 9/08731* (2013.01); *G03G 9/08733* (2013.01); *G03G 9/08797* (2013.01)

(58) Field of Classification Search
CPC ..... G03G 9/00; G03G 5/056; G03G 5/06
USPC ..... 430/109.3, 109.31, 109.4, 119.1
See application file for complete search history.

(56) References Cited

U.S. PATENT DOCUMENTS 4,859,550 A * 8/1989 Gruber et al. ..... 430/39
5,665,513 A 9/1997 Ida et al.

(Continued)

FOREIGN PATENT DOCUMENTS

JP 2006-113473 A 4/2006
JP 2007-33773 A 2/2007

(Continued)

OTHER PUBLICATIONS

Fedors, "A Method for Estimating Both the Solubility Parameters and Molar Volumes of Liquids", Polymer Engineering and Science, 1974, vol. 14, No. 2, pp. 147-154.

*Primary Examiner* — Thorl Chea
(74) *Attorney, Agent, or Firm* — Fitzpatrick, Cella, Harper and Scinto

(57) ABSTRACT

Provided is a toner exhibiting satisfactory fixability even in high-speed fixing process involving a double-sided printing mechanism, keeping stable toner image even after a conveyance step, and doesn't cause curling to a fixing roller even in thin paper. In a toner including toner particles, each of which contains polyester resins A and B, a coloring agent, and a resin composition C, the resin A includes a crystal nucleating agent bonded to a polyester molecular chain including a moiety capable of forming a crystalline structure. The resin B doesn't include a moiety capable of forming a crystalline structure. The composition C is obtained by copolymerizing a vinyl-based resin component with a polyolefin resin component. SP values the resin A, the resin B, the agent, the polyolefin component, and the vinyl-based component satisfy the particular relationships.

5 Claims, 2 Drawing Sheets

(56) References Cited

U.S. PATENT DOCUMENTS

| | | | |
|---|---|---|---|
| 5,700,617 | A | 12/1997 | Takiguchi et al. |
| 5,747,209 | A | 5/1998 | Takiguchi et al. |
| 5,795,693 | A | 8/1998 | Okado et al. |
| 5,851,714 | A | 12/1998 | Taya et al. |
| 5,912,099 | A | 6/1999 | Kanbayashi et al. |
| 5,994,018 | A | 11/1999 | Iida et al. |
| 6,001,525 | A | 12/1999 | Ida et al. |
| 6,013,402 | A | 1/2000 | Kanbayashi et al. |
| 6,022,659 | A | 2/2000 | Kanbayashi et al. |
| 6,146,801 | A | 11/2000 | Ichikawa et al. |
| 6,316,156 | B1 | 11/2001 | Takiguchi et al. |
| 6,528,222 | B2 | 3/2003 | Kohtaki et al. |
| 6,586,147 | B2 | 7/2003 | Iida et al. |
| 6,641,967 | B2 | 11/2003 | Takiguchi et al. |
| 6,751,424 | B2 | 6/2004 | Komatsu et al. |
| 6,808,852 | B2 | 10/2004 | Hotta et al. |
| 6,875,549 | B2 | 4/2005 | Yamazaki et al. |
| 6,881,527 | B2 | 4/2005 | Moribe et al. |
| 6,929,894 | B2 | 8/2005 | Sugahara et al. |
| 7,001,703 | B2 | 2/2006 | Moribe et al. |
| 7,022,449 | B2 | 4/2006 | Sugahara et al. |
| 7,097,951 | B2 | 8/2006 | Moribe et al. |
| 7,112,395 | B2 | 9/2006 | Ida et al. |
| 7,115,349 | B2 | 10/2006 | Iida et al. |
| 7,138,213 | B2 | 11/2006 | Itakura et al. |
| 7,144,668 | B2 | 12/2006 | Baba et al. |
| 7,147,980 | B2 | 12/2006 | Itakura et al. |
| 7,244,539 | B2 | 7/2007 | Baba et al. |
| 7,267,919 | B2 | 9/2007 | Moribe et al. |
| 7,273,686 | B2 | 9/2007 | Onuma et al. |
| 7,288,348 | B2 | 10/2007 | Hayami et al. |
| 7,288,354 | B2 | 10/2007 | Moribe et al. |
| 7,300,733 | B2 | 11/2007 | Sugahara et al. |
| 7,351,509 | B2 | 4/2008 | Moribe et al. |
| 7,422,832 | B2 | 9/2008 | Ogawa et al. |
| 7,452,647 | B2 | 11/2008 | Hayami et al. |
| 7,455,947 | B2 | 11/2008 | Ida et al. |
| 7,537,877 | B2 | 5/2009 | Yoshiba et al. |
| 7,544,457 | B2 | 6/2009 | Hashimoto et al. |
| 7,611,813 | B2 | 11/2009 | Ida et al. |
| 7,629,100 | B2 | 12/2009 | Okamoto et al. |
| 7,638,251 | B2 | 12/2009 | Yamazaki et al. |
| 7,700,254 | B2 | 4/2010 | Moribe et al. |
| 7,767,370 | B2 | 8/2010 | Ishigami et al. |
| 7,816,063 | B2 | 10/2010 | Hashimoto et al. |
| 7,855,042 | B2 | 12/2010 | Kobori et al. |
| 7,906,262 | B2 | 3/2011 | Ishigami et al. |
| 8,057,977 | B2 | 11/2011 | Moribe et al. |
| 8,114,562 | B2 | 2/2012 | Ishigami et al. |
| 8,142,972 | B2 | 3/2012 | Hotta et al. |
| 8,216,754 | B2 | 7/2012 | Ikeda et al. |
| 8,501,377 | B2 | 8/2013 | Takahashi et al. |
| 8,512,925 | B2 | 8/2013 | Moribe et al. |
| 2003/0224278 | A1* | 12/2003 | Shirai et al. ..... 430/109.4 |
| 2010/0248126 | A1 | 9/2010 | Ishigami et al. |
| 2011/0097661 | A1 | 4/2011 | Ishigami et al. |
| 2013/0244164 | A1 | 9/2013 | Fujikawa et al. |
| 2013/0244166 | A1 | 9/2013 | Yamazaki et al. |
| 2013/0252167 | A1 | 9/2013 | Moribe et al. |
| 2013/0288174 | A1 | 10/2013 | Shiotari et al. |
| 2013/0302730 | A1 | 11/2013 | Takahashi et al. |
| 2013/0309603 | A1 | 11/2013 | Takahashi et al. |
| 2014/0038098 | A1 | 2/2014 | Naka et al. |

FOREIGN PATENT DOCUMENTS

| | | | |
|---|---|---|---|
| JP | 2010-102058 | A | 5/2010 |
| JP | 2010-152102 | A | 7/2010 |
| JP | 2011-138120 | A | 7/2011 |

* cited by examiner

TONER

BACKGROUND OF THE INVENTION

1. Field of the Invention

The present invention relates to a toner to be used for electrophotography, an image formation method for visualizing an electrostatic charge image, and a toner jet method.

2. Description of the Related Art

As general electrophotography, there has been known a method involving forming a latent image on an image bearing member (photosensitive member), visualizing the latent image by supplying a toner to the latent image, transferring the toner image onto a transfer member such as paper, and fixing the toner image onto the transfer member with heat or pressure to obtain a duplicate.

In order to save power and shorten wait time in an electrophotographic apparatus, an on-demand type fixing device has been put into practical use as a fixing device, the on-demand type fixing device including a combination of a ceramic heater having small heat capacity and a film.

In the above-mentioned fixing device, an attempt has been made to reduce an internal pressure of a fixing nip of the fixing device from the viewpoints of prolonging life and handling various media.

Further, along with the recent increase in printing speed, the time during which a toner and a medium such as paper pass through a nip of the fixing device is becoming short year after year.

Further, there is a situation in which the output onto thin paper by double-sided printing is increasing owing to the users' enhanced awareness of energy saving.

Further, in recent years, there are increasing chances that users output graphic images each having a high printing ratio, such as image data and posters captured by digital cameras, mobile terminals, and the like, through use of an image forming apparatus such as a laser printer (LBP).

Against such a background, there has been a demand for a toner which can be used for double-sided image formation using thin paper even at a high image formation speed under a low pressure of a fixing nip.

In order to satisfy the demand, it is necessary to achieve low-temperature fixability of a toner which is superior to the conventional one. As a technology for improving the low-temperature fixability, there have been a great number of proposals concerning using a crystalline resin as well as an amorphous resin as a binder resin.

It is known that the crystalline resin can improve the low-temperature fixability by being rapidly melted in the vicinity of its glass transition temperature to enhance the compatibility with the amorphous resin (for example, Japanese Patent Application Laid-Open No. 2010-102058).

Further, in order to improve the low-temperature fixability and enhance the effect of dispersing a release agent through use of the crystalline resin, there has been proposed a toner containing a graft copolymer of a polyolefin resin and a vinyl copolymer (for example, Japanese Patent Application Laid-Open No. 2011-138120).

However, when the compatibility between the crystalline resin and the amorphous resin is too high, there arises a problem in that the heat-resistance storage property and crystallinity of a toner are rather degraded.

In contrast, when the compatibility between the amorphous resin and the crystalline resin is degraded, although a crystal of the crystalline resin tends to be formed more easily, the amorphous resin and the crystalline resin are difficult to be compatible with each other even at a melting point or more.

Therefore, it is difficult to improve the low-temperature fixability, in particular, in the case of short fixing time or a low internal pressure of a nip.

In order to solve the above-mentioned problem, there has been disclosed a technology for accelerating recrystallization of a crystalline resin by adding the step of performing heat treatment at particular temperature during the production of a toner (Japanese Patent Application Laid-Open No. 2010-152102).

Certainly, with the technology, a toner can be obtained which contains a crystalline resin having a high degree of crystallinity and which is excellent in heat-resistance storage property.

However, once the toner is melted during a fixing step, the crystalline resin and the amorphous resin become compatible with each other and do not return to a phase-separated state formed of the crystalline resin and the amorphous resin even when cooled. Therefore, when transfer paper on which a fixed toner image has been formed is left to stand in an overlapped state or in contact with another member under a high-temperature and high-humidity environment, the toner image adheres to the transfer paper or the member with which the toner image comes into contact in some cases.

Meanwhile, there has been proposed a procedure for accelerating the crystallization of a crystalline resin by adding a crystal nucleating agent to a toner.

As the crystal nucleating agent, there have been proposed an inorganic crystal nucleating agent of a fine particle such as silica (for example, Japanese Patent Application Laid-Open No. 2007-033773) and an organic crystal nucleating agent such as a benzoic acid metal salt or fatty acid amide (for example, Japanese Patent Application Laid-Open No. 2006-113473).

However, when the formulated amount of the inorganic crystal nucleating agent such as silica is large, the inorganic crystal nucleating agent exhibits a filler effect to enhance the melt viscosity of a toner, which may inhibit the low-temperature fixability. Further, the inorganic crystal nucleating agent influences the charging characteristics in most cases, with the result that it becomes difficult to control the chargeability in most cases.

On the other hand, the organic nucleating agent is a low-molecular compound such as a benzoic acid metal salt or a fatty acid metal salt in most cases. Such a crystal nucleating agent is likely to be segregated on the surface of a toner. As a result, the effect of the crystal nucleating agent becomes insufficient, and the storage property of the toner is degraded and the storage stability of a toner image is degraded in some cases. Further, after the toner is fixed, parts of crystals are in an incomplete crystalline state even when being recrystallized. Therefore, when the fixed toner is left to stand for a long period of time, a crystalline part and a compatible part are phase-separated, and a fixed image is curled in some cases owing to the reduction in volume of the crystalline part.

Accordingly, there remain a great number of technical problems to be solved for satisfying both the low-temperature fixability and the long-term storage stability of a fixed image, and the conventional toner still has room for improvement.

SUMMARY OF THE INVENTION

In view of the foregoing, the present invention is directed to providing a toner solving the above-mentioned problems.

Specifically, the present invention is directed to providing a toner satisfying both the low-temperature fixability and the long-term storage stability of a fixed image.

Further, the present invention is directed to providing a toner capable of obtaining a fixed toner image excellent in storage property even when the image is formed under a low internal pressure of a fixing nip by a high-speed fixing process having a double-sided printing mechanism.

According to one aspect of the present invention, there is provided a toner including toner particles, each of which contains a polyester resin A, a polyester resin B, a coloring agent, and a resin composition C, in which:

(1) the polyester resin A includes a polyester part including a moiety capable of forming a crystalline structure and a crystal nucleating agent part, the crystal nucleating agent part being bonded to an end of the polyester part;

(2) the polyester resin B is a resin free of a moiety capable of forming a crystalline structure; and (3) the resin composition C is a resin composition including a vinyl-based resin component and a polyolefin resin component bonded to each other, and in which Sa, Sb, Sc, Sd, and Se satisfy the following relationships:

$$9.0 \leq Sa \leq 12.5$$

$$0 \leq |Sc - Sd| \leq 1.8$$

$$2.6 \leq Se - Sd \leq 4.6$$

$$-2.0 \leq Sb - Sa \leq 0.8$$

where the Sa $((cal/cm^3)^{1/2})$ represents an SP value of the polyester part in the polyester resin A, the Sb $((cal/cm^3)^{1/2})$ represents an SP value of the polyester resin B, the Sc $((cal/cm^3)^{1/2})$ represents an SP value of the crystal nucleating agent part in the polyester resin A, the Sd $((cal/cm^3)^{1/2})$ represents an SP value of the polyolefin resin component, and the Se $((cal/cm^3)^{1/2})$ represents an SP value of the vinyl-based resin component.

Further features of the present invention will become apparent from the following description of exemplary embodiments with reference to the attached drawings.

DESCRIPTION OF THE EMBODIMENTS

Figure 1:
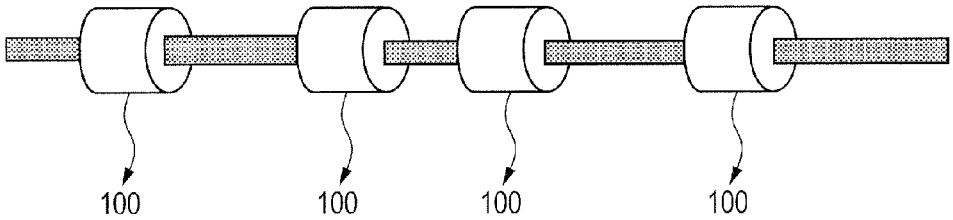
FIG. 1 is a schematic view illustrating an example of a conveyance roller.

In order to fix an image having a large loading amount of a toner, such as a graphic image, onto thin paper at a high speed under a low pressure by double-sided printing, it is necessary that a toner in an image upper layer and a toner in an image lower layer be melted and fixed instantaneously. Therefore, a toner is required to have sharp meltability. In general, in order to enhance the sharp meltability, a material having high crystallinity is used, and of those materials each having high crystallinity, crystalline polyester has come to be used frequently in recent years.

Although various process have been proposed for maintaining crystallinity, there still remain problems to be solved for achieving the above-mentioned desired fixability and long-term storage stability. Then, the inventors of the present invention have improved the low-temperature fixability and the image storage property at a time when high-speed double-sided printing is performed, by producing a toner containing a polyester resin having a moiety capable of forming a crystalline structure, a resin free of a moiety capable of forming a crystalline structure, and a resin composition containing a vinyl-based resin component and a polyolefin resin component bonded to each other, in which SP values of these components are controlled.

The detail of the toner is hereinafter described.

When a polyester resin A is heated to temperature equal to or more than a melting point, the polyester resin A becomes compatible with a polyester resin B to exhibit a plasticizing effect. In this case, the glass transition temperature (Tg) of a toner is greatly decreased, and thus the low-temperature fixability of the toner is improved. That is, it is important that the polyester resin A and the polyester resin B be compatible with each other during fixing.

On the other hand, when the polyester resin A and the polyester resin B become compatible with each other at room temperature, the heat-resistance storage property of the toner is degraded. Therefore, at room temperature, it is important that the polyester resin A and the polyester resin B have a phase separation structure, and a crystalline component have a high degree of crystallinity. It is important that the crystalline component have a high degree of crystallinity not only during storage before the toner is used for forming an image but also during storage as a toner image after the image is formed. Thus, the toner of the present invention has the following feature: the polyester resin A and polyester resin B of the toner have a reversible phase transition structure in which the resins have a phase separation structure before the toner is used for forming an image, become compatible with each other at fixing temperature and return to the phase separation structure rapidly after fixing.

That is, the toner of the present invention has the feature that a state change between the compatible state at high temperature and the phase separation state at room temperature occurs very rapidly.

In order to realize the above-mentioned feature, the following is important:

i) the toner contains the polyester resin A including a polyester part having a moiety capable of forming a crystalline structure and a crystal nucleating agent part, the crystal nucleating agent part being bonded to an end of the polyester part, ii) the toner contains the polyester resin B free of a moiety capable of forming a crystalline structure, iii) the toner contains a resin composition including a vinyl-based resin component and a polyolefin resin component bonded to each other, and iv) SP values of the components are controlled.

In order for the polyester resin A to have a high degree of crystallinity, it is necessary that an SP value Sa $((cal/cm^3)^{1/2})$ of the polyester part in the polyester resin A be 9.0 or more and 12.5 or less. The SP value Sa is preferably 9.7 or more and 10.7 or less. That the SP value Sa is low means that the number of carbon atoms of an aliphatic carboxylic acid and/or an aliphatic alcohol forming the polyester part is large.

In order to obtain a high degree of crystallinity, it is necessary that the SP value Sa be 9.0 or more for the following reason: a larger number of carbon atoms is preferred, that is, it is preferred that the SP value Sa be as low as possible; however, when the SP value Sa is too low, the compatibility of the polyester resin A with respect to the polyester resin B in a fixing temperature range tends to be degraded.

On the other hand, when the SP value Sa is larger than 12.5, the compatibility of the polyester resin A with respect to the polyester resin B becomes excess, and the storage property of a fixed toner image is degraded. Further, when double-sided printing is performed through use of thin paper, the heated fixed toner is likely to cause adverse effects of adhering to or curling to a member in the apparatus.

Those adverse effects are considered to occur easily as a result of the following: when the toner on a fixed image is present in a compatible state, the glass transition temperature (Tg) of the toner on the image is decreased, and the melt viscosity of the toner on the image is slightly decreased in a high-temperature environment.

Note that each SP value as used herein was calculated from the kind and ratio of a monomer forming a resin through use of a generally used method of which some are described in Fedors (Poly. Eng. Sci., 14(2) 147 (1974)).

Next, that a toner image formed through use of the toner of the present invention has excellent storage stability is described.

The toner having passed through a fixing nip is rapidly decreased in temperature during a fixing step.

When the toner contains merely the crystalline polyester resin A and the polyester resin B, a compatible part remains in the toner decreased in temperature rapidly, and a soft part is to be present on the surface of the toner. Therefore, during storage, a toner image adheres to a transfer member which comes into contact with the surface of the toner image, and the toner adheres to a member coming into contact with the toner image, such as a conveyance roller 100 (FIG. 1).

In the present invention, the polyester resin A has the crystal nucleating agent part accelerating high crystallinity at an end of the polyester part. The crystal nucleating agent part interacts with a polyolefin resin component in a resin composition C present in the toner, and thus the crystallization (cooling crystallization) of the crystal nucleating agent part proceeds when the temperature of the toner is decreased rapidly. Along with this, the recrystallization of the polyester part of the polyester resin A also occurs. Accordingly, the storage stability is enhanced, and the toner is prevented from adhering to the transfer member or peripheral member with which the surface of the toner image comes into contact.

In general, the crystal moiety is formed when a crystal core is formed and then a crystal grows. By bonding a crystal nucleating agent to an end of a polyester molecular chain, the crystal growth of a moiety capable of forming a crystalline structure (that is, polyester part in the polyester resin A, which is hereinafter sometimes referred to as "moiety a") can be accelerated directly, and the crystallization speed can be enhanced further than before.

In the case where the crystal nucleating agent is not bonded to the polyester part, the crystallization of the moiety a cannot be accelerated directly, and hence the crystal growth speed is low, with the result that the toner cannot be subjected to reversible phase transition. Further, the crystal nucleating agent is generally a low molecular body, and hence the crystal nucleating agent is deposited on the surface of the toner easily, which may degrade the heat-resistance storage property of the toner.

No particular limitation is imposed on the crystal nucleating agent forming the crystal nucleating agent part as long as the crystal nucleating agent is a compound having a crystallization speed higher than that of the moiety a. Note that, from the viewpoint of a high crystallization speed, it is preferred that the crystal nucleating agent be a compound having a main chain containing a hydrocarbon-based moiety and having a mono- or higher-valent functional group capable of reacting with the end of the polyester part.

From the viewpoint of more easily enhancing a crystallization speed, it is preferred that the crystal nucleating agent be a compound containing a straight-chain hydrocarbon-based moiety and having a monovalent functional group. Further, from the viewpoint of enhancing the reactivity between the crystal nucleating agent and the end of the resin A, the molecular weight of the crystal nucleating agent is preferably 100 to 10,000, more preferably 150 to 5,000.

Although no particular limitation is imposed on the crystal nucleating agent, it is preferred that the crystal nucleating agent be a moiety derived from an aliphatic carboxylic acid having 10 or more and 30 or less carbon atoms and/or an aliphatic alcohol having 10 or more and 30 or less carbon atoms. This is because the degree of crystallinity of the crystal nucleating agent is enhanced when the crystal nucleating agent has a predetermined number or more of carbon atoms. Further, such moiety has molecular mobility higher than that of the moiety a of the polyester resin A, and hence it is also preferred that the crystal nucleating agent be such moiety from the viewpoint of enhancing the crystallization speed of a crystal core.

From the viewpoint of enhancing a crystallization speed, the addition amount of the crystal nucleating agent is preferably 0.1 mol part or more and 7.0 mol parts or less, more preferably 0.2 mol part or more and 5.0 mol parts or less, with respect to 100 mol parts of a material monomer forming the polyester part in the polyester resin A.

Whether or not the crystal nucleating agent was bonded to the polyester part was determined by the following analysis.

2 mg of a resin sample were precisely weighed, and 2 ml of chloroform were added to dissolve the resin sample, thereby preparing a sample solution. Although the polyester resin A which is a material for the toner is used as the resin sample, a toner containing the polyester resin A may be used instead in the case where it is difficult to obtain the polyester resin A.

Next, 20 mg of 2,5-dihydroxybenzoic acid (DHBA) were precisely weighed, and 1 ml of chloroform was added to dissolve DHBA, thereby preparing a matrix solution.

Then, 3 mg of sodium trifluoroacetate (NaTFA) were precisely weighed, and 1 ml of acetone was added to dissolve NaTFA, thereby preparing an ionization assistant solution.

25 μl of the sample solution, 50 μl of the matrix solution, and 5 μl of the ionization assistant solution thus prepared were mixed, and the mixture was added dropwise to a sample plate for MALDI analysis and dried to obtain a measurement sample.

A mass spectrum was obtained through use of MALDI-TOF MS (Reflex III manufactured by Bruker Daltonics) as analytical equipment.

In the mass spectrum thus obtained, the assignment of each peak of an oligomer region (m/Z was 2,000 or less) was performed to confirm whether or not a peak corresponding to composition containing the crystal nucleating agent bonded to the molecular end was present, and thus it was determined whether or not the molecular end of the polyester part and the crystal nucleating agent were bonded to each other.

In order to enhance the degree of crystallinity of the polyester resin A, it is necessary to control the other components in addition to the above-mentioned crystal nucleating agent and the SP value of each component. The detail of the control is described.

Figure 2:
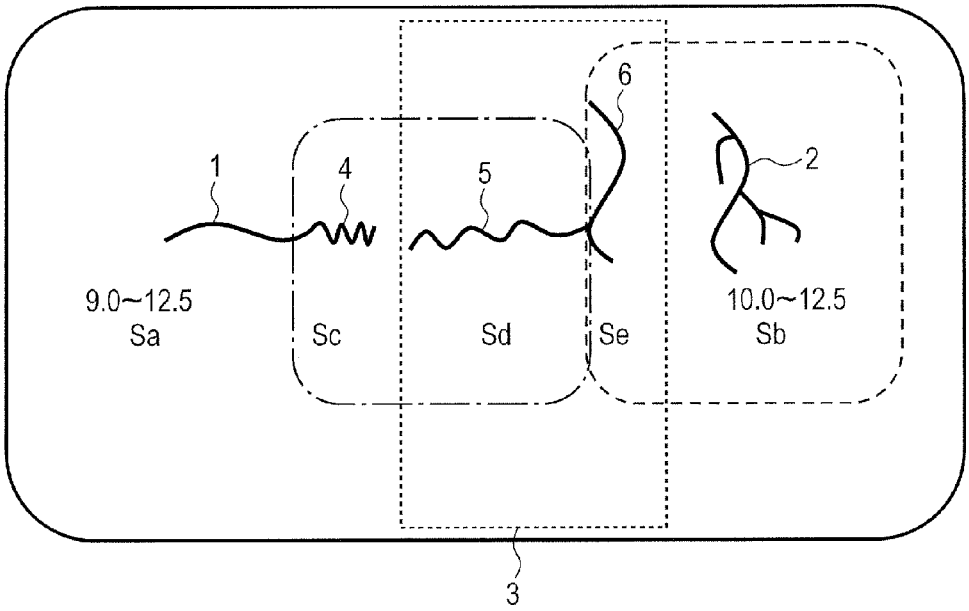
FIG. 2 is a schematic diagram regarding SP values of a polyester resin A, a polyester resin B, and a resin composition C of the present invention.

FIG. 2 is a schematic diagram regarding SP values of a polyester resin A1, a polyester resin B2, and a resin composition C3. Further, the SP values of the respective resin components satisfy the following relationships.

$$0 \leq |Sc-Sd| \leq 1.8 \quad (1)$$

$$2.6 \leq Se-Sd \leq 4.6 \quad (2)$$

$$-2.0 \leq Sb-Sa \leq 0.8 \quad (3)$$

The respective SP values in the expressions mean the SP values of the following components.

Sa: SP value of the polyester part in the polyester resin A $((cal/cm^3)^{1/2})$ Sb: SP value of the polyester resin B $((cal/cm^3)^{1/2})$ Sc: SP value of the crystal nucleating agent part in the polyester resin A $((cal/cm^3)^{1/2})$ Sd: SP value of the polyolefin resin component in the resin composition C $((cal/cm^3)^{1/2})$ Se: SP value of the vinyl-based resin component in the resin composition C $((cal/cm^3)^{1/2})$ Expressions (1) to (3) are described in detail below.

In order to complete the recrystallization of the polyester resin A1 rapidly, it is most important that the SP value of a crystal nucleating agent part (4) at the end of the polyester part (1) be close to the SP value of a polyolefin resin component (5) in the resin composition C3. The following is considered regarding two substances having close SP values. When the substances are heated to be compatible with each other, the substances gather closely, and the crystal nucleating agent part is aligned around the polyolefin resin component. Along with this, the polyester part bonded to the crystal nucleating agent part is also aligned (see FIG. 3).

In addition, the polyester part at the end of the polyester resin A is strongly subjected to the crystallization acceleration function of the crystal nucleating agent part when cooled rapidly, and hence the recrystallization of the polyester resin A is accelerated. In order to achieve this, it is required that the SP value Sc of the crystal nucleating agent part and the SP value Sd of the polyolefin resin component satisfy the following relationship.

$$0 \leq |Sc-Sd| \leq 1.8$$

Further, it is preferred that the following relationship be satisfied.

$$0 \leq Sc-Sd| \leq 1.6$$

Figure 3:
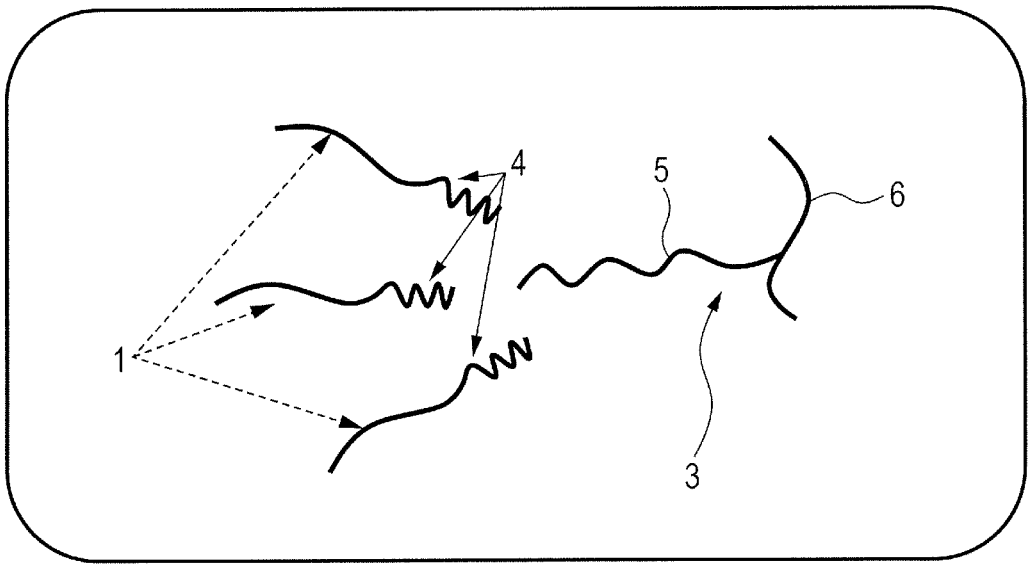
FIG. 3 is a diagram illustrating a compatible state of the polyester resin A and the resin composition C of the present invention.

In the case where (Sc−Sd) is larger than 1.8, the polyester resin B enters between the crystal nucleating agent part and the polyolefin resin part when the resin is in a molten state, and such an aggregate as illustrated in FIG. 3 cannot be formed, with the result that the crystal nucleating agent part cannot sufficiently accelerate the recrystallization of the polyester resin in some cases.

Further, the requirement for causing the rapid recrystallization of the polyester resin A is described.

The resin composition C is a resin composition containing a vinyl-based resin component (6) and a polyolefin resin component (5) bonded to each other (see FIG. 3), and the relationship between the SP value of the vinyl-based resin component and the SP value of the polyolefin resin component is as described below.

$$2.6 \leq Se-Sd \leq 4.6$$

More preferably, a relationship of $3.0 \leq Se-Sd \leq 4.3$ is satisfied.

This shows that there is a large difference in the SP value between the polyolefin resin part and vinyl-based resin component in the resin composition C. That is, it is considered that, when the SP value Se of the vinyl-based resin component is larger than the SP value Sd, the polyester resin B gathers easily in the vicinity of the vinyl-based resin component during heat melting.

Thus, during heat melting, the polyolefin resin part in the resin composition C and the crystal nucleating agent part at the end of the polyester resin A are likely to face each other.

It is not preferred that the difference in SP value be smaller than 2.6 because, when double-sided printing is performed on thin paper by a high-speed process, the heated fixed toner is likely to adhere to a conveyance member to have adverse effects on an image.

Those adverse effects are considered to be caused on the image as follows: the toner on the fixed image is cooled without being recrystallized sufficiently, and the compatible part which partially remains adheres to the conveyance member to have the adverse effects on the image.

It is also not preferred that the difference in SP value be larger than 4.6, because, when double-sided printing is performed on thin paper by a high-speed process, the heated fixed toner is likely to adhere to the conveyance member to have adverse effects on an image. It is considered that those adverse effects on the image are caused as follows: the difference between the resin composition C and the polyester resin B becomes too large, and the resin composition C is separated from the other resin components (polyester resin A, polyester resin B) during heat melting, with the result that the polyester resin A and the polyolefin resin part in the resin composition C do not interact with each other.

Further, it is preferred that the resin composition C be contained in the toner in an amount of 0.5 mass % or more and 15 mass % or less based on the mass of the toner.

The resin composition C is described in detail below.

The resin composition C includes a polyolefin resin (X) and a vinyl-based resin (Y) bonded to each other.

The softening point of the polyolefin resin (X) is generally 80 to 170° C., preferably 90 to 160° C., more preferably 100 to 155° C. When the softening point is more than 80° C., the flowability of the toner becomes satisfactory, and when the softening point is less than 170° C., the sufficient release effect is exhibited.

The melt viscosity of the polyolefin resin (X) is generally 2 to 10,000 mPa·s, preferably 3 to 7,000 mPa·s, more preferably 5 to 4,500 mPa·s at 160° C.

From the viewpoint of avoiding the adhesion of the toner to a fixing member and the like, the polyolefin resin (X) preferably has a number-average molecular weight of 500 to 20,000 and a weight-average molecular weight of 800 to 100,000, more preferably have a number-average molecular weight of 1,000 to 15,000 and a weight-average molecular weight of 1,500 to 60,000, still more preferably have a number-average molecular weight of 1,500 to 10,000 and a weight-average molecular weight of 2,000 to 30,000.

The SP value of the vinyl-based resin (Y) is generally 10.6 to 12.6 $(cal/cm^3)^{1/2}$, preferably 10.6 to 12.0 $(cal/cm^3)^{1/2}$. The vinyl-based resin (Y), which may be (a) a single polymer of a vinyl-based monomer (A) whose SP value as a single polymer is 10.6 to 12.6 $(cal/cm^3)^{1/2}$, is more preferably (b) a copolymer of the vinyl-based monomer (A) whose SP value as a single polymer is 11.0 to 18.0 and a monomer (B) whose SP value as a single polymer is 8.0 to 11.0 $(cal/cm^3)^{1/2}$.

An unsaturated nitrile-based monomer (A1) and an α,β-unsaturated carboxylic acid (A2) are given as the vinyl-based monomer (A).

Examples of the unsaturated nitrile-based monomer (A1) include acrylonitrile, methacrylonitrile, and cyanostyrene. Of those, acrylonitrile and methacrylonitrile are preferred. Examples of the α,β-unsaturated carboxylic acid (A2)

include: an unsaturated carboxylic acid and an anhydride thereof (e.g., acrylic acid, methacrylic acid, maleic acid, fumaric acid, itaconic acid, or an anhydride thereof); and an unsaturated dicarboxylic acid monoester (e.g., monomethyl maleate, monobutyl maleate, or monomethyl itaconate). Of those, acrylic acid, methacrylic acid, and unsaturated dicarboxylic acid monoesters are preferred, and acrylic acid, methacrylic acid, and maleic acid monoesters (monomethyl maleate and monobutyl maleate) are particularly preferred.

Examples of the monomer (B) include:

styrene-based monomers such as styrene, α-methylstyrene, p-methylstyrene, m-methylstyrene, p-methoxystyrene, p-hydroxystyrene, p-acetoxystyrene, vinyltoluene, ethylstyrene, phenylstyrene, and benzylstyrene; alkyl (1 to 18 carbon atoms) esters of an unsaturated carboxylic acid such as methyl acrylate, ethyl acrylate, butyl acrylate, 2-ethylhexyl acrylate, methyl methacrylate, ethyl methacrylate, butyl methacrylate, and 2-ethylhexyl methacrylate;

vinyl ester-based monomers such as vinyl acetate; vinyl ether-based monomers such as vinyl methyl ether; halogen element-containing vinyl-based monomers such as vinyl chloride;

diene-based monomers such as butadiene and isobutylene; and a combination thereof. Of those, a styrene-based monomer, an unsaturated alkyl carboxylate, and a combination thereof are preferred, and styrene, and a combination of styrene and an alkyl acrylate and/or an alkyl methacrylate are particularly preferred.

The vinyl-based resin has preferably a number-average molecular weight of 1,500 to 100,000 and a weight-average molecular weight of 5,000 to 200,000, more preferably a number-average molecular weight of 2,500 to 50,000 and a weight-average molecular weight of 6,000 to 100,000, particularly preferably a number-average molecular weight of 2,800 to 20,000 and a weight-average molecular weight of 7,000 to 50,000.

The glass transition temperature (Tg) of the vinyl-based resin (Y) is preferably 40 to 90° C., more preferably 45 to 80° C., particularly preferably 50 to 70° C. When the glass transition temperature (Tg) is equal to or more than 40° C., the storage property becomes satisfactory, and when the glass transition temperature (Tg) is equal to or less than 90° C., the low-temperature fixability becomes satisfactory.

The amount of the polyolefin resin (X) is preferably 1 to 90 mass %, more preferably 5 to 80 mass % based on the mass of the resin composition C.

Specific combinations of the polyolefin resin (X) and vinyl-based resin (Y) in the resin composition C of the present invention are exemplified below.

(1) (X): oxidation-type polypropylene
(Y): styrene/acrylonitrile copolymer
(2) (X): polyethylene/polypropylene mixture
(Y): styrene/acrylonitrile copolymer
(3) (X): ethylene/propylene copolymer
(Y): styrene/acrylic acid/butyl acrylate copolymer
(4) (X): polypropylene
(Y): styrene/acrylonitrile/butyl acrylate/monobutyl maleate copolymer
(5) (X): maleic acid-modified polypropylene
(Y): styrene/acrylonitrile/acrylic acid/butyl acrylate copolymer
(6) (X): maleic acid-modified polypropylene
(Y): styrene/acrylonitrile/acrylic acid/2-ethylhexyl acrylate copolymer
(7) (X): polyethylene/maleic acid-modified polypropylene mixture
(Y): acrylonitrile/butyl acrylate/styrene/monobutyl maleate copolymer The production method of the resin composition C is described. For example, the resin composition C of the present invention is obtained by dissolving or dispersing the polyolefin resin (X) in a solvent such as toluene or xylene, heating the resultant solution to 100 to 200° C., subjecting the vinyl-based monomer (A) or the mixture of the vinyl-based monomer (A) and the monomer (B) to drop polymerization together with a peroxide-based initiator (benzoyl peroxide, ditertially butyl peroxide, tertially butyl peroxide benzoate, etc.), and distilling away the solvent.

The amount of the peroxide-based initiator to be used for synthesizing a solution of the polymer mixture is generally 0.2 to 10 mass %, preferably 0.5 to 5 mass % based on the mass of the produced polymer mixture.

Further, the requirement for expressing the rapid recrystallization of the polyester resin A is described.

It is necessary that the SP value Sa of the polyester part in the polyester resin A and the SP value Sb of the polyester resin B satisfy the following relationship.

$$-2.0 \leq Sb - Sa \leq 0.8$$

Preferably, a relationship of $-1.8 \leq Sb - Sa \leq 0.7$ is satisfied.

The relationship is an indication of the ease of compatibility during heat melting, and the ease of phase separation at room temperature, between the polyester part of the polyester resin A and the polyester resin B.

Even when the crystal nucleating agent is bonded to the end of the polyester part forming the polyester resin A, in the case where the relationship of Expression (3) is not satisfied, the polyester resin A and the polyester resin B cannot have a reversible phase transition structure.

The SP value (solubility parameter) has been conventionally used as an indication of the ease of mixing between the resins and between the resin and the wax.

It is not preferred that the difference in SP value be less than −2.0 because, when double-sided printing is performed on thin paper, the heated fixed toner may cause adverse effects of adhering to or curling to the member in the apparatus. Those adverse effects are considered to be caused by the following: the toner on the fixed image is not sufficiently recrystallized during the decrease in temperature.

The case where the difference in SP value is larger than 0.8 shows that the polyester part in the polyester resin A and the polyester resin B tend to be phase-separated during fixing. As a result, the low-temperature fixability of the toner is degraded, and for example, in a configuration in which the toner is fixed under a low fixing pressure, it becomes difficult for the toner to be fixed satisfactorily. In general, the fixability is said to be greatly influenced by heat and a pressure.

Further, the requirement for expressing the rapid recrystallization of the polyester resin A is described.

It is preferred that the toner of the present invention satisfy the following relationship.

$$|Sd - Sc| < |Sd - Sa|$$

This relationship is a condition to be required for obtaining the state of FIG. 3 described above. It is considered that the difference in SP value between the crystal nucleating agent and the polyolefin resin component in the resin composition C is smaller than that between the polyester resin A and the polyolefin resin component in the resin composition C, and hence the crystal nucleating agent easily gathers in the polyolefin resin part.

In the case where the above-mentioned relationship becomes opposite, it is considered that the following case may occur. The polyester resin A easily gathers in the polyolefin resin part of the resin composition C, and the existence density of the crystal nucleating agent becomes small. Therefore, the recrystallization speed becomes low, with the result that adverse effects are caused on an image.

Further, it is preferred that the SP value Sb $((cal/cm^3)^{1/2})$ of the polyester resin B be 10.0 or more and 12.5 or less.

Further, the phenomenon in which the rapid recrystallization of the polyester resin A was expressed was confirmed by observing the melting heat quantity. A melting heat quantity ΔH (J/g) in the present invention is a melting heat quantity observed when the toner is melted by increasing temperature temporarily to 180° C. at a temperature increase speed of 100° C./min (first cycle) and is solidified by being cooled to −10° C. at a temperature decrease speed of 100° C./min, and the temperature is increased again to 180° C. at a temperature increase speed of 100° C./min (second cycle).

A more detailed measurement method for each case is described later.

When a part whose cool crystallization has not been completed is present at a measurement start time in the second cycle, recrystallization occurs during an increase in temperature in the measurement with a differential scanning calorimeter (DSC), and an exothermic peak indicating the recrystallization is observed. In the present invention, the cool crystallization is almost completed, and hence the exothermic peak is hardly observed.

The melting heat quantity indicating the recrystallization in the measurement with the DSC in the second cycle is 6.0 J/g or less, more preferably 3.0 J/g or less.

The exothermic peak in the second cycle is observed on a lower temperature side from an endothermic peak of the crystallized polyester resin. For example, in the case where the endothermic peak temperature of the crystallized polyester resin is in the vicinity of 76° C., the exothermic peak occurs in the vicinity of 60° C., which can be easily confirmed.

Further, it is also a characteristic phenomenon of the present invention that the difference in temperature of the endothermic peak in the crystalline site between the first and second cycles is small in the measurement with the DSC. The peak temperature difference is preferably 7.0° C. or less, more preferably 4.0° C. or less. It is considered that the small peak temperature difference indicates that, even when heating and cooling are repeated a number of times under the measurement condition of the DSC, the crystalline resin and the amorphous resin similarly express the compatible state and the separated state repeatedly.

That is, the following is considered. The polyester resin A and the polyester resin B can have a reversible phase transition structure, and hence the low-temperature fixability (low-pressure fixability) of the toner is satisfactory, and a satisfactory image can be obtained even when double-sided printing is performed on thin paper.

No particular limitation is imposed on the polyester resin A as long as the crystal nucleating agent is bonded to the end of a polyester molecular chain, and the polyester molecular chain has a moiety capable of forming a crystalline structure.

Note that, "having a moiety capable of forming a crystalline structure" as used herein means that there are an endothermic peak at a time of an increase in temperature and an exothermic peak at a time of a decrease in temperature in the measurement with the differential scanning calorimeter (DSC), and the measurement is performed in accordance with the measurement method "ASTM D3418-82."

From the viewpoint of increasing the crystallinity of the polyester molecular chain, an aliphatic diol having 6 to 18 carbon atoms is preferably contained in the alcohol component as a material monomer to be used for synthesis of the polyester resin A.

Examples of the aliphatic diol having 6 to 18 carbon atoms include 1,6-hexanediol, 1,7-heptanediol, 1,8-octanediol, 1,9-nonanediol, 1,10-decanediol, 1,11-undecanediol, and 1,12-dodecanediol. Of those, an aliphatic diol having 6 to 12 carbon atoms is preferred from the viewpoints of fixability and thermostability.

From the viewpoint of further increasing the crystallinity, the content of the aliphatic diol having 6 to 18 carbon atoms is preferably 80 to 100 mol % in the alcohol component.

As a polyhydric alcohol component other than the aliphatic diol having 6 to 18 carbon atoms that can be used as an alcohol component, there are given, for example: aromatic diols such as alkylene oxide adducts of bisphenol A represented by the following structural formula (I) including a polyoxypropylene adduct of 2,2-bis(4-hydroxyphenyl)propane and a polyoxyethylene adduct of 2,2-bis(4-hydroxyphenyl)propane; and trihydric or more alcohols such as glycerin, pentaerythritol, and trimethylolpropane:

(I)

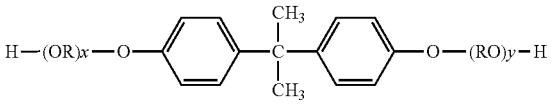

where R represents an alkylene group having 2 or 3 carbon atoms, x and y each represent a positive number, and the sum of x and y is 1 to 16, preferably 1.5 to 5.

In addition, an aliphatic dicarboxylic acid compound having 6 to 18 carbon atoms is preferred as the carboxylic acid component as a material monomer to be used for the synthesis of the polyester resin A from the viewpoint of increasing the crystallinity of the polyester.

As the aliphatic dicarboxylic acid compound having 6 to 18 carbon atoms, there are given, for example, 1,8-octanedioic acid, 1,9-nonanedioic acid, 1,10-decanedioic acid, 1,11-undecanedioic acid, and 1,12-dodecanedioic acid. Of those, an aliphatic dicarboxylic acid compound having 6 to 12 carbon atoms is preferred from the viewpoints of the fixability and thermostability of the toner.

The content of the aliphatic dicarboxylic acid compound having 6 to 18 carbon atoms is preferably 80 to 100 mol % in the carboxylic acid component.

In the present invention, a carboxylic acid component other than the aliphatic dicarboxylic acid compound having 6 to 18 carbon atoms can be used in combination. Examples the component include an aromatic dicarboxylic acid compound and a trivalent or more aromatic polycarboxylic acid compound. The component is not particularly limited thereto.

The aromatic dicarboxylic acid compound also includes an aromatic dicarboxylic acid derivative capable of proving the same constitutional unit as that derived from the aromatic dicarboxylic acid by a condensation reaction. Preferred specific examples of the aromatic dicarboxylic acid compound include: aromatic dicarboxylic acids such as phthalic acid, isophthalic acid, and terephthalic acid; anhydrides thereof; and alkyl (1 to 3 carbon atoms) esters thereof. Examples of the alkyl groups of the alkyl esters include a methyl group, an ethyl group, a propyl group, and an isopropyl group.

Examples of the trivalent or more polycarboxylic acid compound include: aromatic carboxylic acids such as 1,2,4-benzenetricarboxylic acid (trimellitic acid), 2,5,7-naphthalenetricarboxylic acid, and pyromellitic acid; and derivatives such as anhydrides thereof and alkyl (1 to 3 carbon atoms) esters thereof.

It is preferred that the molar ratio between the alcohol component and the carboxylic acid component which are material monomers for a condensation polymerization reaction (carboxylic acid component/alcohol component) be 0.80 or more and 1.20 or less.

In the present invention, it is preferred that a weight-average molecular weight Mwa of the polyester resin A be 8,000 or more and 100,000 or less from the viewpoints of the fixability and the heat-resistance storage property. Further, it is preferred that the relationship between the weight-average molecular weight Mwa and a weight-average molecular weight Mwb of the polyester resin B satisfy the following expression from the viewpoints of: allowing the polyester resins A and B to have a reversible phase transition structure; and further enhancing the low-temperature fixability of the toner and the long-term storage stability of an image.

$Mwb<Mwa$

Further, it is preferred that the polyester resin A of the present invention have a high degree of crystallinity. Therefore, it is preferred that the melting heat quantity ($\Delta H$) obtained from an area of an endothermic peak observed during an increase in temperature in the measurement with the differential scanning calorimeter (DSC) be 100 J/g or more and 140 J/g or less.

Further, the melting point of the polyester resin A is 60° C. or more and 120° C. or less, preferably 70° C. or more and 90° C. or less from the viewpoint of the low-temperature fixability of the toner.

Further, it is preferred that the acid value of the polyester resin A be 2 mgKOH/g or more and 40 mgKOH/g or less from the viewpoint of the satisfactory charging characteristics of the toner.

Further, it is preferred that the hydroxyl value of the polyester resin A be 2 mgKOH/g or more and 40 mgKOH/g or less from the viewpoints of the fixability and the storage stability.

Any polyester obtained by an ordinary production method can be used as the polyester resin B to be used for the toner of the present invention as long as the SP value and the weight-average molecular weight Mwb can be set to desired values.

As the dihydric alcohol component, there may be used, for example, any one of: alkylene oxide adducts of bisphenol A represented by the above-mentioned formula (I) including a polyoxypropylene adduct of 2,2-bis(4-hydroxyphenyl)propane and a polyoxyethylene adduct of 2,2-bis(4-hydroxyphenyl)propane; and ethylene glycol, 1,3-propylene glycol, and neopentyl glycol.

In addition, sorbitol, pentaerythritol, dipentaerythritol, or the like can be used as a trihydric or more alcohol component.

For the polyester resin B capable of being adopted in the present invention, a monomer out of those dihydric alcohol components and trihydric or more alcohol components may be used alone, or multiple monomers thereof may be used in combination.

In addition, examples of the dicarboxylic acid component as the acid component include maleic acid, fumaric acid, phthalic acid, isophthalic acid, terephthalic acid, succinic acid, adipic acid, n-dodecenylsuccinic acid, anhydrides thereof, and lower alkyl esters thereof.

Examples of the trivalent or more polycarboxylic acid component include 1,2,4-benzenetricarboxylic acid, 2,5,7-naphthalenetricarboxylic acid, pyromellitic acid, Empol trimer acid, anhydrides thereof, and lower alkyl esters thereof.

No particular limitation is imposed on the production method of the polyester resin B, and the polyester resin B can be produced by an esterification reaction or transesterification through use of each of the above-mentioned monomers or the like. When the material monomers are polymerized, an esterification catalyst or the like, which is generally used, such as dibutyltin oxide, may be used appropriately for accelerating the reaction.

It is preferred that the glass transition temperature (Tg) of the polyester resin B be 45° C. or more and 70° C. or less from the viewpoints of the fixability and the storage property.

Further, the softening point of the polyester resin B is 80° C. or more and 130° C. or less, preferably 90° C. or more and 120° C. or less from the viewpoint of the low-temperature fixability of the toner.

Further, it is preferred that the acid value of the polyester resin B be 2 mgKOH/g or more and 40 mgKOH/g or less from the viewpoint of the satisfactory charging characteristics of the toner, and that the hydroxyl value of the polyester resin B be 2 mgKOH/g or more and 40 mgKOH/g or less from the viewpoints of the fixability and the storage stability.

Further, it is preferred that the mass ratio between the polyester resin A and the polyester resin B be 5:95 to 40:60 from the viewpoints of the low-temperature fixability of the toner and the long-term storage stability of an image.

The toner of the present invention including the polyester resin A, the polyester resin B, and the resin composition C has a phase separation structure at room temperature. Therefore, it is preferred that various physical properties obtained from the toner apparently have numerical values similar to those of toner physical properties in the case where the toner has a phase separation structure.

It is preferred that the softening point of the toner be 80° C. or more and 120° C. or less from the viewpoint of the low-temperature fixability of the toner.

Further, it is preferred that the weight-average molecular weight of the toner be 3,000 or more and 100,000 or less from the viewpoints of the fixability and high-temperature offset prevention.

In the present invention, a wax can be used as required to impart releasability to the toner.

As the wax, in terms of dispersability in the toner and high releasability, hydrocarbon-based waxes such as low-molecular weight polyethylene, low-molecular weight polypropylene, a microcrystalline wax, and a paraffin wax are preferably used. One kind of the release agents may be used alone or two or more kinds thereof may be used in combination in a small amount, if necessary. In addition, a product obtained by kneading the resin composition C with the wax and pulverizing the kneaded product in advance may be used.

The following may be given as specific examples: Biscol (trademark) 330-P, 550-P, 660-P, and TS-200 (Sanyo Chemical Industries, Ltd.); Hiwax 400P, 200P, 100P, 410P, 420P, 320P, 220P, 210P, and 110P (Mitsui Chemicals, Inc.); Sasol H1, H2, C80, C105, and C77 (Schumann Sasol); HNP-1, HNP-3, HNP-9, HNP-10, HNP-11, and HNP-12 (NIPPON SEIRO CO., LTD.); Unilin (trademark) 350, 425, 550, and 700, and Unisid (trademark), Unisid (trademark) 350, 425, 550, and 700 (TOYO-PETROLITE); and a haze wax, a beeswax, a rice wax, a candelilla wax, and a carnauba wax (available from CERARICA NODA Co., Ltd.).

The wax may be added at the time of the melting and kneading during the production of the toner, or may be added at the time of the production of the polyester resin B, and the timing is appropriately selected from existing methods. In addition, one kind of those waxes may be used alone, or two or more kinds thereof may be used in combination.

The wax is preferably added in an amount of 1 part by mass or more and 20 parts by mass or less with respect to 100 parts by mass of the binder resin.

The toner of the present invention may be a magnetic toner or a non-magnetic toner. In the case where the toner of the present invention is used as a magnetic toner, it is preferred to use magnetic iron oxide. Iron oxide such as magnetite, maghemite, or ferrite is used as the magnetic iron oxide. Further, in order to enhance fine dispersibility of the magnetic iron oxide in toner particles, it is preferred that slurry of the magnetic iron oxide during production be sheared so that the magnetic iron oxide can be loosened temporarily.

In the present invention, the amount of the magnetic iron oxide to be contained in the toner is preferably 25 mass % or more and 45 mass % or less, more preferably 30 mass % or more and 45 mass % or less in the toner.

In the case where the toner of the present invention is used as a non-magnetic toner, carbon black and conventionally known various pigments and dyes can be used alone or in combination of at least two kinds as a coloring agent.

The amount of the coloring agent is preferably 0.1 part by mass or more and 60.0 parts by mass or less, more preferably 0.5 part by mass or more and 50.0 parts by mass or less with respect to 100.0 parts by mass of the binder resin.

Further, in the toner of the present invention, a flowability improver having a high ability to impart flowability to the surface of a toner particle can be used as inorganic fine powder. Any improver can be used as the flowability improver as long as the improver can enhance the flowability of a toner particle after being externally added thereto. For example, there are given the following: fluorine-based resin powder such as vinylidene fluoride fine powder and polytetrafluoroethylene fine powder; fine powder silica such as wet process silica and dry process silica; and treated silica obtained by subjecting silica to surface treatment with a silane coupling agent, a titanium coupling agent, or silicone oil. As the preferred flowability improver, there is given fine powder generated by vapor phase oxidation of a silicon-halogen compound, which is called dry process silica or fumed silica. For example, such fine powder is generated through use of a pyrolysis oxidation reaction of silicon tetrachloride gas in oxygen and hydrogen, and a reaction formula is as described below.

$$SiCl_4+2H_2+O_2 \rightarrow SiO_2+4HCl$$

Further, the flowability improver may be composite fine powder of silica and another metal oxide obtained by using another metal halogen compound such as aluminum chloride or titanium chloride together with the silicon-halogen compound during the production process.

Further, it is preferred to use treated silica fine powder obtained by hydrophobizing silica fine powder generated by vapor phase oxidation of the silica-halogen compound. In the treated silica fine powder, it is particularly preferred that silica fine powder be treated so that the hydrophobized degree titrated by a methanol titration test exhibits a value in a range of 30 or more and 98 or less.

Hydrophobicity is imparted through chemical treatment with an organosilicon compound that reacts with or physically adsorbs to the silica fine powder. The hydrophobizing treatment is preferably performed by a method involving treating the silica fine powder produced by vapor phase oxidation of the silicon-halogen compound with the organosilicon compound. Examples of the organosilicon compound include the following: hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, a triorganosilylmercaptan, trimethylsilylmercaptan, a triorganosilyl acrylate, vinyldimethylacetoxysilane, dimethylethoxysilane, dimethyldimethoxysilane, diphenyldiethoxysilane, 1-hexamethyldisiloxane, 1,3-divinyltetramethyldisiloxane, 1,3-diphenyltetramethyldisiloxane, and a dimethylpolysiloxane having 2 to 12 siloxane units per molecule and containing a hydroxyl group bonded to one Si atom in a unit positioned at the end. One kind of those compounds is used alone, or two or more kinds thereof are used as a mixture.

The silica fine powder may be treated with silicone oil, and may be subjected to the treatment in addition to the hydrophobizing treatment.

As preferred silicone oil, there is used one having a viscosity at 25° C. of 30 $mm^2/s$ or more and 1,000 $mm^2/s$ or less. For example, dimethyl silicone oil, methylphenyl silicone oil, α-methylstyrene-modified silicone oil, chlorophenyl silicone oil, or fluorine-modified silicone oil is particularly preferred.

As a silicone oil treatment method, there are given the following methods: a method involving directly mixing silica fine powder treated with a silane coupling agent and silicone oil with a mixer such as a Henschel mixer; a method involving spraying silicone oil to silica fine powder serving as a base; and a method involving dissolving or dispersing silicone oil in an appropriate solvent, and thereafter, adding and mixing silica fine powder to the resultant solution and removing the solvent. In the silicone oil treated silica, it is more preferred to heat silica to a temperature of 200° C. or more (more preferably 250° C. or more) in inactive gas after treating the silica with silicone oil, thereby stabilizing a coat on the surface of the silica.

As a preferred silane coupling agent, there is given hexamethyldisilazane (HMDS).

In the present invention, it is preferred that silica be treated with a coupling agent in advance and then be treated with silicone oil, or that silica be treated with a coupling agent and silicone oil simultaneously.

It is appropriate that the inorganic fine powder is used in an amount of 0.01 part by mass or more and 8.00 parts by mass or less, preferably 0.10 part by mass or more and 4.00 parts by mass or less with respect to 100.00 parts by mass of the toner particles.

Other external additives may be added to the toner of the present invention as necessary. Examples of the external additives include an auxiliary charging agent, a conductivity imparting agent, a flowability imparting agent, a caking inhibitor, a release agent for heat roller fixing, a lubricant, and resin fine particles and inorganic fine particles serving as an abrasive.

Examples of the lubricant include polyethylene fluoride powder, zinc stearate powder, and polyvinylidene fluoride powder. Of those, polyvinylidene fluoride powder is preferable. Examples of the abrasive include cerium oxide powder, silicon carbide powder, and strontium titanate powder. The toner of the present invention can be obtained by sufficiently mixing such external additive with the toner particles with a mixer such as a Henschel mixer.

The toner of the present invention can be used as a one-component type developer and can also be used as a two-component type developer by being mixed with a magnetic carrier.

As the magnetic carrier, for example, there may be used generally known carriers including magnetic materials such as: iron powder whose surface is oxidized or unoxidized iron powder; particles of metals such as iron, lithium, calcium, magnesium, nickel, copper, zinc, cobalt, manganese, and rare earths, particles of alloys thereof, and particles of oxides thereof; and ferrite and a magnetic material-dispersed resin carrier (so-called resin carrier) containing a binder resin holding such magnetic material in a dispersed state.

When the toner of the present invention is mixed with the magnetic carrier so as to be used as a two-component type developer, the mixing ratio of the magnetic carrier in this case is adjusted so that the concentration of the toner in the developer is preferably 2 mass % or more and 15 mass % or less.

Although no particular limitation is imposed on the production method of the toner of the present invention, it is preferred to use a pulverizing method involving the production steps of melting and kneading the polyester resin A and the polyester resin B, and the resin composition C, and cooling and solidifying the resultant from the viewpoint of obtaining a toner more excellent in low-temperature fixability.

The pulverizing method is preferred for the following reason: a molecular chain of the polyester resin A can enter the polyester resin B and the resin composition C easily by mixing the polyester resins A and B, and the resin composition C with shearing added during melting and kneading, and hence the polyester resins A and B can be compatibilized uniformly during melting, whereby the low-temperature fixability can be enhanced.

Hitherto, in the case of using the pulverizing method, the crystallinity of the polyester resin A, and the compatibility of the polyester resin A and the polyester resin B have not been controlled enough. Therefore, once the polyester resins A and B are compatibilized, it is difficult to form a crystal part in a toner.

However, in the toner of the present invention, reversible phase transition is caused by controlling the crystal nucleating agent bonded to a molecular end of the polyester resin A and the SP value of each of the resin composition C and the polyester resin B, and thus, a desired toner can be obtained.

In the material mixing step, as materials for constituting the toner particles, for example, the polyester resin A, the polyester resin B, the resin composition C, the coloring agent, and any other additive are weighed in predetermined amounts, and then blended and mixed. An apparatus for the mixing is, for example, a double cone mixer, a V type mixer, a drum type mixer, a Super mixer, a Henschel mixer, a Nauta Mixer, or a Mechano Hybrid (manufactured by NIPPON COKE & ENGINEERING CO., LTD.).

Next, the mixed materials are melted and kneaded so that the coloring agent and the like may be dispersed in the polyester resins. In the melting and kneading step, a batch type kneading machine such as a pressure kneader or a Banbury mixer, or a continuous kneading machine can be used, and a single or twin screw extruder is mainly used because of an advantage in that continuous production can be performed. Examples thereof include a KTK type twin screw extruder (manufactured by KOBE STEEL, LTD.), a TEM type twin screw extruder (manufactured by Toshiba Machine Co., Ltd.), a PCM kneader (manufactured by Ikegai Corp.), a twin screw extruder (manufactured by KCK), a co-kneader (manufactured by BUSS), and a Kneadex (manufactured by NIPPON COKE & ENGINEERING CO., LTD.). Further, a resin composition to be obtained by the melting and kneading is rolled with a two-roll or the like, and may be cooled with water or the like in a cooling step.

Next, in a pulverizing step, the cooled resin composition is pulverized so as to have a desired particle diameter. In the pulverizing step, for example, the cooled resin composition is coarsely pulverized with a pulverizer such as a crusher, a hammer mill, or a feather mill, and is then further finely pulverized with, for example, a Kryptron System (manufactured by Kawasaki Heavy Industries, Ltd.), a Super Rotor (manufactured by Nisshin Engineering Inc.), a Turbo Mill (manufactured by FREUND-TURBO CORPORATION), or a fine pulverizer of an air-jet mode.

After that, as required, the pulverized product is classified with a classifier or a screen classifier, such as an Elbow Jet (manufactured by Nittetsu Mining Co., Ltd.) of an inertial classification system, a Turboplex (manufactured by Hosokawa Micron Corporation) of a centrifugal force classification system, a TSP Separator (manufactured by Hosokawa Micron Corporation), or a Faculty (manufactured by Hosokawa Micron Corporation). Thus, toner particles are obtained.

Further, as required, the pulverized product may be subjected to a surface modification treatment for toner particles such as a spheroidization treatment using a Hybridization System (manufactured by Nara Machinery Co., Ltd.), a Mechanofusion System (manufactured by Hosokawa Micron Corporation), a Faculty (manufactured by Hosokawa Micron Corporation), or a Meteorainbow MR Type (manufactured by Nippon Pneumatic Mfg. Co., Ltd.).

Further, if necessary, a desired additive can be sufficiently mixed with the toner particles with a mixer such as a Henschel mixer to obtain the toner of the present invention.

The methods of measuring physical properties of the resins and toner of the present invention are as described below. Examples described later are also based on those methods.

(Measurement of Weight-Average Molecular Weight by Gel Permeation Chromatography (GPC))

A weight-average molecular weight is measured by stabilizing a column in a heat chamber at 40° C. and flowing tetrahydrofuran (THF) as a solvent to the column at 40° C. at a flow velocity of 1 ml per minute to inject about 100 μl of a THF sample solution to the column. For measuring the molecular weight of a sample, a molecular weight distribution of the sample was obtained from a relationship between the logarithmic value and count value of a calibration curve created through use of several kinds of monodisperse polystyrene standard samples. For example, a standard polystyrene sample having a molecular weight of about $10^2$ to $10^7$ manufactured by Tosoh Corporation or Showa Denko Co., Ltd. is used as the standard polystyrene sample for creating the calibration curve, and it is preferred that at least about 10 standard polystyrene samples be used. In addition, a refractive index (RI) detector is used as a detector. It is recommended that multiple commercially available polystyrene gel columns be combined to be used as the column. Examples of the commercially available polystyrene gel columns include the following combinations: Shodex GPC KF-801, 802, 803, 804, 805, 806, 807, and 800P manufactured by Showa Denko K.K.; and TSK gel G1000H($H_{XL}$), G2000H($H_{XL}$), G3000H ($H_{XL}$), G4000H($H_{XL}$), G5000H($H_{XL}$) G6000H($H_{XL}$), G7000H($H_{XL}$), and TSK gurd column manufactured by Tosoh Corporation.

Further, a sample is produced as described below.

A sample is put in THF and left to stand at 25° C. for several hours. Then, the sample is shaken sufficiently so as to be mixed well with THF (until a composite body of the sample disappears). The resultant is further left to stand still for 12 hours or more. In this case, the time during which the sample is left to stand in THF is adjusted to 24 hours. After that, the resultant is passed through a sample treatment filter (pore size: 0.2 μm or more and 0.5 μm or less, for example, Myshori-Disk H-25-2 (manufactured by Tosoh Corporation) or the like can be used) to obtain a sample of GPC. Further, the concentration of the sample is adjusted so that a resin component has a concentration of 0.5 mg/ml or more and 5.0 mg/ml or less.

(Measurement of Melting Points and Melting Heat Quantities of Polyester Resin and Wax)

Regarding the melting point and melting heat quantity of each of the polyester resin and the wax, in a DSC curve measured in accordance with ASTM D3418-82 through use of a differential scanning calorimeter "Q2000" (manufactured by TA Instruments Co., Ltd.), the peak temperature of the maximum endothermic peak is defined as the melting point, and a heat quantity determined from the area of the peak is defined as the melting heat quantity.

For correcting the temperature of an apparatus detecting part, the melting points of indium and zinc are used, and for correcting the heat quantity, the melting heat quantity of indium is used. Specifically, about 2 mg of a sample are precisely weighed, and the sample is put in a pan made of aluminum. An empty pan made of aluminum is used as a reference. Measurement is performed at a temperature increase speed of 10° C./min in a measurement temperature range of 30 to 200° C. Note that, in the measurement, the temperature is temporarily increased to 200° C., decreased to 30° C., and then, increased again. The maximum endothermic peak temperature of the DSC curve in the temperature range of 30 to 200° C. in the second temperature increase process is defined as a melting point, and the heat quantity determined from the area of the peak is defined as the melting heat quantity.

(Measurement of Glass Transition Temperatures (Tg) of Polyester Resin and Toner)

The glass transition temperature (Tg) of each of the polyester resin and the toner is measured in accordance with ASTM D3418-82 through use of a differential scanning calorimeter "Q2000" (manufactured by TA Instruments Co., Ltd.). For correcting the temperature of an apparatus detecting part, the melting points of indium and zinc are used, and for correcting the heat quantity, the melting heat quantity of indium is used. Specifically, about 2 mg of a sample are precisely weighed, and the sample is put in a pan made of aluminum. An empty pan made of aluminum is used as a reference. Measurement is performed at a temperature increase speed of 10° C./min in a measurement temperature range of 30 to 200° C. Note that, in the measurement, the temperature is temporarily increased to 200° C., decreased to 30° C., and then, increased again. A specific heat variation is obtained in a temperature range of 40° C. to 100° C. in the second temperature increase process. An intersection between a line intermediate between base lines before and after the specific heat change and the differential thermal curve is defined as the glass transition temperature (Tg) of each of the polyester resin and toner.

(Measurement of Softening Points of Polyester Resin and Toner)

The softening point of each of the polyester resin and the toner is measured through use of a constant-pressure extrusion system capillary rheometer "flow characteristic-evaluating apparatus Flow Tester CFT-500D" (manufactured by Shimadzu Corporation) in accordance with the manual attached to an apparatus. In this apparatus, a measurement sample filled in a cylinder is increased in temperature to be melted while a predetermined load is applied to the measurement sample with a piston from above, and the melted measurement sample is extruded from a die in a bottom part of the cylinder. At this time, a flow curve representing a relationship between the piston descent amount and the temperature can be obtained.

In the present invention, a "Melting temperature in a ½ method" described in the manual attached to the "flow characteristic-evaluating apparatus Flow Tester CFT-500D" is defined as a softening point. Note that the melting temperature in a ½ method is calculated described below. First, ½ of a difference between a descent amount $S_{max}$ of the piston at a time when outflow is finished and a descent amount $S_{min}$ of the piston at a time when outflow is started is determined (The ½ of the difference is defined as X. $X=(S_{max}-S_{min})/2$). Then, the temperature in the flow curve when the descent amount of the piston reaches a sum of X and $S_m$, in the flow curve is the melting temperature in the ½ method.

The measurement sample is obtained by subjecting about 1.0 g of a sample to compression molding for about 60 seconds under about 10 MPa through use of a tablet compressing machine (for example, NT-100H, manufactured by NPa SYSTEM Co., Ltd.) under an environment of 25° C. to form the sample into a cylindrical shape having a diameter of about 8 mm.

The measurement conditions of the CFT-500D are as described below.

Test mode: heating method

Temperature increase speed: 4° C./min

Starting temperature: 50° C.

Reached temperature: 200° C.

(Measurement of Acid Value of Polyester Resin)

The acid value is a milligram number of potassium hydroxide required for neutralizing an acid contained in 1 g of a sample. The acid value of the polyester resin is measured in accordance with JIS K0070-1992, specifically, the following procedure.

(1) Preparation of reagent 1.0 g of phenolphthalein is dissolved in 90 ml of ethyl alcohol (95 vol %), and ion exchange water is added to the resultant to obtain 100 ml of a phenolphthalein solution.

7 g of guaranteed potassium hydroxide are dissolved in 5 ml of water, and ethyl alcohol (95 vol %) is added to the resultant to obtain 1 L of a solution. The solution is put in a container having alkali resistance so as not to come into contact with carbon dioxide gas and the like, and is left to stand for three days. After that, the solution is filtered to obtain a potassium hydroxide solution. The potassium hydroxide solution thus obtained is stored in the container having alkali resistance. The factor of the potassium hydroxide solution is determined by putting 25 ml of 0.1 mol/l hydrochloric acid in an Erlenmeyer flask, adding drops of the phenolphthalein solution to the hydrochloric acid, titrating the resultant with the potassium hydroxide solution, and obtaining the amount of the potassium hydroxide solution used for neutralization. Hydrochloric acid prepared in accordance with JIS K8001-1998 is used as the 0.1 mol/l hydrochloric acid.

(2) Operation (A) Main Test 2.0 g of a sample of a pulverized polyester resin are precisely weighed in a 200-ml Erlenmeyer flask, and 100 ml of a mixed solution of toluene/ethanol (2:1) are added to the sample to dissolve the sample over five hours. Then, drops of the phenolphthalein solution as an indicator are added to the resultant, and the mixture thus obtained is titrated with the potassium hydroxide solution. Note that the titration is finished when the indicator continues to exhibit a pale red color for about 30 seconds.

(B) Blank Test

The same titration as that in the above-mentioned operation is performed except that the sample is not used (that is, only the mixed solution of toluene/ethanol (2:1) is used).

(3) The result thus obtained is substituted into the following expression to calculate an acid value:

$$A=[(C-B)\times f\times 5.61]/S$$

where A represents an acid value (mgKOH/g), B represents an addition amount (ml) of the potassium hydroxide solution in the blank test, C represents an addition amount (ml) of the potassium hydroxide solution in the main test, f represents the factor of the potassium hydroxide solution, and S represents the sample (g).

(Measurement of Hydroxyl Value of Polyester Resin)

A hydroxyl value is a milligram number of potassium hydroxide required for neutralizing acetic acid bonded to a hydroxyl group when 1 g of a sample is acetylated. The hydroxyl value of the polyester resin is measured in accordance with JIS K0070-1992, specifically, the following procedure.

(1) Preparation of reagent 25 g of guaranteed acetic anhydride are put in a 100-ml volumetric flask, and pyridine is added so as to obtain an entire amount of 100 ml. The resultant is shaken sufficiently to obtain an acetylated reagent. The obtained acetylated reagent is stored in a brown bottle so as not to come into contact with moisture, carbon dioxide gas, and the like.

1.0 g of phenolphthalein is dissolved in 90 ml of ethyl alcohol (95 vol %), and ion exchange water is added to the resultant to obtain 100 ml of a phenolphthalein solution.

35 g of guaranteed potassium hydroxide are dissolved in 20 ml of water, and ethyl alcohol (95 vol %) is added to the resultant to obtain 1 L of a solution. The solution is put in a container having alkali resistance so as not to come into contact with carbon dioxide gas and the like, and is left to stand for three days. After that, the solution is filtered to obtain a potassium hydroxide solution. The potassium hydroxide solution thus obtained is stored in the container having alkali resistance. The factor of the potassium hydroxide solution is determined by putting 25 ml of 0.5 mol/l hydrochloric acid in an Erlenmeyer flask, adding drops of the phenolphthalein solution to the hydrochloric acid, titrating the resultant with the potassium hydroxide solution, and obtaining the amount of the potassium hydroxide solution used for neutralization. Hydrochloric acid prepared in accordance with JIS K8001-1998 is used as the 0.5 mol/l hydrochloric acid.

(2) Operation (A) Main Test 1.0 g of a sample of a pulverized polyester resin is precisely weighed in a 200-ml round bottom flask, and 5.0 ml of the acetylated reagent are precisely added to the sample through use of a whole pipette. In this case, when the sample is not dissolved in the acetylated reagent easily, a small amount of guaranteed toluene is added to the sample to dissolve it.

A small funnel is put on the mouth of the flask, and the flask is heated with about 1 cm of the bottom part thereof soaked in a glycerin bath at about 97° C. In order to prevent the temperature of the neck of the flask from increasing owing to the heat of the bath in this case, it is preferred that the base of the neck of the flask be covered with a cardboard having a round hole.

One hour later, the flask is taken out of the glycerin bath and is left to cool down. After the flask is left to cool down, 1 ml of water is added through the funnel, and the flask is shaken to subject acetic anhydride to hydrolysis. In order to perform the hydrolysis further completely, the flask is heated again in the glycerin bath for 10 minutes. After the flask is left to cool down, the walls of the funnel and the flask are washed with 5 ml of ethyl alcohol.

Drops of the phenolphthalein solution as an indicator are added to the resultant, and the solution thus obtained is titrated with the potassium hydroxide solution. Note that the titration is finished when the indicator continues to exhibit a pale red color for about 30 seconds.

(B) Blank Test

The same titration as that in the above-mentioned operation is performed except that the sample of the polyester resin is not used.

(3) The result thus obtained is substituted into the following expression to calculate a hydroxyl value:

$$A=[\{(B-C)\times 28.05\times f\}/S]+D$$

where A represents a hydroxyl value (mgKOH/g), B represents an addition amount (ml) of the potassium hydroxide solution in the blank test, C represents an addition amount (ml) of the potassium hydroxide solution in the main test, f represents the factor of the potassium hydroxide solution, S represents the sample (g), and D represents an acid value (mgKOH/g) of the polyester resin.

(Method of Measuring Weight-Average Particle Diameter (D4))

The weight-average particle diameter (D4) of the toner was measured with the number of effective measurement channels of 25,000 by using a precision particle size distribution-measuring apparatus based on a pore electrical resistance method provided with a 100-μm aperture tube "Coulter Counter Multisizer 3" (trademark manufactured by Beckman Coulter, Inc.) and dedicated software included thereto "Beckman Coulter Multisizer 3 Version 3.51" (manufactured by Beckman Coulter, Inc.) for setting measurement conditions and analyzing measurement data. Then, the measurement data was analyzed to calculate the diameter.

An electrolyte solution prepared by dissolving guaranteed sodium chloride in ion-exchanged water so as to have a concentration of about 1 mass %, for example, an "ISOTON II" (manufactured by Beckman Coulter, Inc.) can be used in the measurement.

It should be noted that the dedicated software was set as described below prior to the measurement and the analysis.

In the "change standard measurement method (SOM)" screen of the dedicated software, the total count number of a control mode is set to 50,000 particles, the number of times of measurement is set to 1, and a value obtained by using "standard particles each having a particle diameter of 10.0 μm" (manufactured by Beckman Coulter, Inc.) is set as a Kd value. A threshold and a noise level are automatically set by pressing a threshold/noise level measurement button. In addition, a current is set to 1,600 μA, a gain is set to 2, and an electrolyte solution is set to an ISOTON II, and a check mark is placed in a check box as to whether the aperture tube is flushed after the measurement.

In the "setting for conversion from pulse to particle diameter" screen of the dedicated software, a bin interval is set to a logarithmic particle diameter, the number of particle diameter bins is set to 256, and a particle diameter range is set to the range of 2 μm to 60 μm.

A specific measurement method is as described below.

(1) About 200 ml of the electrolyte solution are charged into a 250-ml round-bottom beaker made of glass dedicated for the Multisizer 3. The beaker is set in a sample stand, and the electrolyte solution in the beaker is stirred with a stirrer rod at 24 rotations/sec in a counterclockwise direction. Then, dirt and bubbles in the aperture tube are removed by the "aperture flush" function of the analytical software.

(2) About 30 ml of the electrolyte solution are charged into a 100-ml flat-bottom beaker made of glass. About 0.3 ml of a diluted solution prepared by diluting a "Contaminon N" (a 10-mass % aqueous solution of a neutral detergent for washing a precision measuring device formed of a nonionic surfactant, an anionic surfactant, and an organic builder and having a pH of 7 manufactured by Wako Pure Chemical Industries, Ltd.) with ion-exchanged water by three parts by mass fold is added as a dispersant to the electrolyte solution.

(3) An ultrasonic dispersing unit "Ultrasonic Dispension System Tetora 150" (manufactured by Nikkaki Bios Co., Ltd.) in which two oscillators each having an oscillatory frequency of 50 kHz are built so as to be out of phase by 180° and which has an electrical output of 120 W is prepared. A predetermined amount of ion-exchanged water is charged into the water tank of the ultrasonic dispersing unit. About 2 ml of the Contaminon N are charged into the water tank.

(4) The beaker in the section (2) is set in the beaker fixing hole of the ultrasonic dispersing unit, and the ultrasonic dispersing unit is operated. Then, the height position of the beaker is adjusted in order that the liquid level of the electrolyte solution in the beaker may resonate with an ultrasonic wave from the ultrasonic dispersing unit to the fullest extent possible.

(5) About 10 mg of toner are gradually added to and dispersed in the electrolyte solution in the beaker in the section (4) in a state in which the electrolyte solution is irradiated with the ultrasonic wave. Then, the ultrasonic dispersion treatment is continued for an additional 60 seconds. It should be noted that the temperature of water in the water tank is appropriately adjusted so as to be 10° C. or more and 40° C. or less upon ultrasonic dispersion.

(6) The electrolyte solution in the section (5) in which the toner has been dispersed is dropped with a pipette to the round-bottom beaker in the section (1) placed in the sample stand, and the concentration of the toner to be measured is adjusted to about 5%. Then, measurement is performed until the particle diameters of 50,000 particles are measured.

(7) The measurement data is analyzed with the dedicated software included with the apparatus, and the weight-average particle diameter (D4) is calculated. It should be noted that an "average diameter" on the "analysis/volume statistics (arithmetic average)" screen of the dedicated software when the dedicated software is set to show a graph in a vol % unit is the weight-average particle diameter (D4).

(Measurement of Melting Heat Quantity ΔH)

The melting heat quantity ΔH of the toner was measured under the following conditions through use of an input compensation type differential scanning calorimeter "DSC8500" (manufactured by PerkinElmer, Inc.).

First, calibration files under the respective conditions of a temperature increase speed of 100° C./min and a temperature increase speed of 10° C./min were created according to the following procedure.

A. Creation of Calibration File (1) Base Line Measurement

Base line measurement was conducted in accordance with the following program under the condition of a nitrogen flow rate of 30 ml/min with Pt covers being attached to a reference part and a measurement part which were both in an empty state. In this case, a calibration file at a temperature increase speed of 10° C./min obtained from a manufacturer at a time of purchase was used.

Step 1: Keep the temperature at −70° C. for 5 minutes.

Step 2: Increase the temperature from −70° C. to 500° C. at a desired temperature increase speed (100° C./min or 10° C./min).

(2) Measurement of Melting Start Temperature and Melting Heat Quantity of Indium A reference pan was inserted into the reference part, and an indium pan was inserted into the measurement part. Then, Pt covers were attached respectively to the reference part and the measurement part, and measurement was conducted in accordance with the following program at a nitrogen flow rate of 30 ml/min.

Step 1 Keep the temperature at 30° C. for 2 minutes.

Step 2 Increase the temperature from 30° C. to 500° C. at a desired temperature increase speed (100° C./min or 10° C./min).

The melting start temperature and melting heat quantity of indium at each temperature increase speed were determined from the analysis of the measurement result of indium thus obtained. In this case, a calibration file at a temperature increase speed of 10° C./min obtained from a manufacturer at a time of purchase was used.

(3) Creation of Calibration File at Each Temperature Increase Speed

A calibration file at each temperature increase speed was created by performing base line calibration, sample temperature calibration, furnace calibration, and heat flow calibration according to the following procedure.

Regarding the base line calibration, base line calibration values (slope, balance rough adjustment, balance fine adjustment) were adjusted by being increased or decreased with reference to the curve of the base line obtained in the section (1) so as to obtain a flat base line.

Regarding the sample temperature calibration, the sample temperature was calibrated manually through use of the measured value of the melting start temperature of indium obtained in the section (2) and a theoretical temperature (156.6° C.) so that the measured value became the theoretical temperature.

Regarding the furnace calibration, the furnace was calibrated by performing autorun in a measurement temperature range of 50 to 350° C.

Regarding the heat flow calibration, the heat flow was calibrated manually through use of the measured value of the melting heat quantity of indium obtained in the section (2) and a melting heat theoretical value (28.45 J/g) so that the measured value became the melting heat theoretical value.

B. Measurement of ΔH (Temperature Increase Speed 100° C./min)

About 5 mg of a sample were precisely weighed and put in a pan made of aluminum to obtain a sample pan. The sample pan was inserted into a measurement part, and an empty pan made of aluminum as a reference was inserted into a reference part. Pt covers were attached respectively to the measurement part and the reference part.

Then, the endothermic quantity of the toner was measured in accordance with the following temperature program under a condition of a nitrogen flow rate of 30 ml/min through use of a calibration file created at a temperature increase speed of 100° C./min.

Step 1 Keep the temperature at −10° C. for 5 minutes.

Step 2 Increase the temperature from −10° C. to 180° C. at a temperature increase speed of 100° C./min.

Step 3 Keep the temperature at 180° C. for 10 minutes.

Step 4 Decrease the temperature from 180° C. to −10° C. at a temperature decrease speed of 100° C./min.

Step 5 Keep the temperature at −10° C. for 10 minutes.

Step 6 Increase the temperature from −10° C. to 180° C. at a temperature increase speed of 100° C./min.

The endothermic quantity was measured in accordance with the program, and the endothermic quantity curve obtained in Step 6 (second temperature increase process) was analyzed for melting heat quantity. Specifically, the melting heat quantity ΔH was determined from the area of a peak derived from the polyester resin A in an endothermic peak having appeared on an endothermic side with respect to the base line.

Further, in the case where the toner contains wax in addition to the polyester resin A, the melting peak temperature of the polyester resin A is close to that of the wax, and hence the melting peaks overlap each other, resulting in difficulty in peak separation in some cases.

In such a case, first, regarding the endothermic quantity curve obtained in Step 6 of the toner, a sum ΔH1 of the melting heat quantity of the polyester resin A and that of the wax is determined from the total area of the overlapping melting peaks of the polyester resin A and the wax. Then, a toner for comparison containing the wax at the same content (mass %) as that of the above-mentioned toner and not containing the polyester resin A as a binder resin was prepared, and the endothermic quantity was measured in accordance with the above-mentioned temperature program. Thus, a melting heat quantity ΔH2 of only the wax in the toner was obtained.

Then, a difference between the ΔH1 and the ΔH2 was obtained to determine the melting heat quantity ΔH derived from the polyester resin A in the toner.

EXAMPLES

Basic configuration and features of the present invention are described above. The present invention is hereinafter described specifically by way of examples. However, the embodiments of the present invention are not limited to the examples. In the examples, the number of parts refers to parts by mass.

(Production of Polyester Resin A)

(Production Example of Polyester Resin A1)

1,10-decanediol as an alcohol monomer and 1,10-decanedioic acid as an acid monomer were supplied to a reaction vessel equipped with a nitrogen introduction tube, a dehydration tube, a stirrer, and a thermocouple in blending amounts shown in Table 1.

Then, as a catalyst, 1 part by mass of tin dioctoate was added to the mixture based on 100 parts by mass of the total amount of the monomers, and the resultant was reacted for 7 hours while water was being distilled away under normal atmospheric pressure by heating the resultant to 140° C. under a nitrogen atmosphere.

Then, the resultant was reacted while the temperature was being increased to 200° C. at 10° C./hour and reacted for 2 hours after the temperature reached 190° C. Then, the inside of the reaction vessel was reduced in pressure to 5 kPa or less, and the resultant was reacted at 190° C. for 3 hours.

After that, the pressure in the reaction vessel was gradually reduced to be returned to normal atmospheric pressure. Then, a crystal nucleating agent (octadecanoic acid) shown in Table 1 was added to the resultant, and the resultant was reacted at 200° C. for 2 hours under normal atmospheric pressure. After that, the inside of the reaction vessel was again reduced in pressure to 5 kPa or less, and the resultant was reacted at 190° C. for 3 hours to obtain a polyester resin A1.

Table 2 shows various physical properties of the polyester resin A1 thus obtained.

(Production Examples of Polyester Resins A2 to A14)

Polyester resins A2 to A14 were obtained in the same way as in the production example of the polyester resin A1 except for using monomer species and blending amounts, and crystal nucleating agents shown in Table 1. Table 2 shows various physical properties thereof.

TABLE 1

| | Monomer configuration | | | | | | | | |
|---|---|---|---|---|---|---|---|---|---|
| | Alcohol component | Sp value | Molar ratio | Acid component | SP value | Molar ratio | Crystal nucleating agent | Molar ratio | SP value (Sc) |
| Polyester resin A1 | 1,10-decanediol | 9.84 | 100 | 1,10-decanedioic acid | 9.77 | 100 | Octadecanoic acid | 4 | 9.0 |
| Polyester resin A2 | 1,6-hexanediol | 10.83 | 100 | 1,10-decanedioic acid | 9.77 | 100 | 1-octadecanol | 4 | 9.1 |
| Polyester resin A3 | 1,10-decanediol | 9.84 | 100 | 1,12-dodecanedioic acid | 9.66 | 100 | Octadecanoic acid | 4 | 9.0 |
| Polyester resin A4 | Ethylene glycol | 14.11 | 100 | 1,8-octanedioic acid | 10.41 | 100 | Octadecanoic acid | 4 | 9.0 |
| Polyester resin A5 | 1,18-octadecanediol | 9.08 | 100 | 1,18-octadecanedioic acid | 9.14 | 100 | Octadecanoic acid | 4 | 9.0 |
| Polyester resin A6 | 1,10-decanediol | 9.84 | 100 | 1,4-butanedioic acid | 12.35 | 100 | Octadecanoic acid | 4 | 9.0 |
| Polyester resin A7 | Ethylene glycol | 14.11 | 100 | 1,6-hexanedioic acid | 11.1 | 100 | Octadecanoic acid | 4 | 9.0 |
| Polyester resin A8 | 1,6-hexanediol | 10.83 | 100 | 1,12-dodecanedioic acid | 9.66 | 100 | — | — | — |
| Polyester resin A9 | 1,10-decanediol | 9.84 | 100 | 1,4-butanedioic acid | 12.35 | 100 | — | — | — |
| Polyester resin A10 | Ethylene glycol | 14.11 | 100 | 1,6-hexanedioic acid | 11.1 | 100 | — | — | — |
| Polyester resin A11 | 1,10-decanediol | 9.84 | 100 | 1,6-hexanedioic acid | 11.1 | 100 | Dodecanoic acid | 4 | 9.6 |
| Polyester resin A12 | 1,12-dodecanediol | 9.57 | 100 | 1,14-tetradecanedioic acid | 9.44 | 100 | Octacosanoic acid | 4 | 8.7 |
| Polyester resin A13 | 1,10-decanediol | 9.84 | 100 | 1,6-hexanedioic acid | 11.1 | 100 | Octanoic acid | 4 | 10.2 |
| Polyester resin A14 | 1,18-octadecanediol | 9.08 | 100 | 1,18-octadecanedioic acid | 9.14 | 100 | Dotriacontanoic acid | 4 | 8.5 |

TABLE 2

| | Physical properties | | | | | |
|---|---|---|---|---|---|---|
| | SP value of polyester part $(cal/cm^3)^{1/2}$ | Melting point ° C. | ΔH J/g | Weight-average molecular weight Mwa | Acid value mgKOH/g | Hydroxyl value mgKOH/g |
| Polyester resin A1 | 10.1 | 76 | 130 | 20,000 | 3 | 15 |
| Polyester resin A2 | 10.5 | 72 | 120 | 18,000 | 3 | 17 |
| Polyester resin A3 | 9.8 | 79 | 125 | 22,000 | 3 | 13 |
| Polyester resin A4 | 12.4 | 70 | 110 | 18,000 | 2 | 14 |
| Polyester resin A5 | 9.1 | 68 | 109 | 17,000 | 3 | 15 |
| Polyester resin A6 | 11.1 | 88 | 120 | 19,000 | 3 | 16 |
| Polyester resin A7 | 12.7 | 70 | 110 | 17,000 | 2 | 14 |
| Polyester resin A8 | 8.9 | 88 | 125 | 19,000 | 3 | 13 |
| Polyester resin A9 | 10.2 | 96 | 140 | 25,000 | 3 | 16 |
| Polyester resin A10 | 12.6 | 96 | 140 | 25,000 | 3 | 16 |
| Polyester resin A11 | 10.3 | 66 | 111 | 15,500 | 3 | 15 |
| Polyester resin A12 | 9.4 | 91 | 131 | 21,000 | 3 | 15 |
| Polyester resin A13 | 10.4 | 66 | 106 | 15,000 | 4 | 18 |
| Polyester resin A14 | 9.0 | 96 | 137 | 26,000 | 2 | 15 |

(Production of Polyester Resin B)

(Production Example of Polyester Resin B1)

Monomers in blending amounts shown in Table 3 were supplied to a reaction vessel equipped with a nitrogen introduction tube, a dehydration tube, a stirrer, and a thermocouple, and 1.6 parts by mass of dibutyltin as a catalyst were added to the monomers based on 100 parts by mass of the total amount of the monomers.

Then, the resultant was rapidly increased in temperature to 180° C. under normal atmospheric pressure under a nitrogen atmosphere and subjected to polymerization condensation by distilling away water while heating the resultant at a temperature increase speed of 10° C./hour from 180° C. to 220° C.

After the temperature of the resultant reached 220° C., the inside of the reaction vessel was reduced in pressure to 5 kPa or less, and the resultant was subjected to polymerization condensation under conditions of 220° C. and 5 kPa or less to obtain a polyester resin B1.

In this case, the polymerization time was adjusted so that the softening point of the polyester resin B1 to be obtained became a value shown in Table 4. Table 4 shows various physical properties of the obtained polyester resin B1.

(Production Examples of Polyester Resins B2 to B5)

Polyester resins B2 to B5 were obtained in the same way as in the production example of the polyester resin B1 except for using monomer species and blending amounts shown in Table 3. Table 4 shows various physical properties thereof.

TABLE 3

| | Acid component (mol) | | | | | Alcohol component (mol) | | | |
|---|---|---|---|---|---|---|---|---|---|
| | TPA | IPA | TMA | FA | DSA | BPA-PO | BPA-EO | EG | NPG |
| Polyester resin B1 | 100 | 0 | 10 | 0 | 0 | 30 | 20 | 22 | 0 |
| Polyester resin B2 | 85 | 0 | 30 | 5 | 0 | 65 | 35 | 0 | 0 |
| Polyester resin B3 | 50 | 0 | 0 | 0 | 0 | 20 | 0 | 15 | 60 |
| Polyester resin B4 | 100 | 0 | 0 | 0 | 0 | 0 | 20 | 80 | 0 |
| Polyester resin B5 | 10 | 0 | 20 | 50 | 0 | 15 | 0 | 50 | 0 |

TPA; Terephthalic acid
IPA; Isophthalic acid
TMA; Trimellitic acid
FA; Fumaric acid
DSA; Dodecenylsuccinic acid
BPA-PO; Bisphenol A-PO 2 mol adduct
BPA-EO; Bisphenol A-EO 2 mol adduct
EG; Ethylene glycol
NPG; Neopentyl glycol

TABLE 4

| | SP value (cal/cm$^3$)$^{12}$ | Weight-average molecular weight Mwb | Tg ° C. | Softening point ° C. | Acid value mgKOH/g | Hydroxyl value mgKOH/g |
|---|---|---|---|---|---|---|
| Polyester resin B1 | 10.6 | 7,000 | 56 | 105 | 14 | 26 |
| Polyester resin B2 | 10.1 | 8,000 | 55 | 100 | 16 | 26 |
| Polyester resin B3 | 9.7 | 9,000 | 56 | 110 | 14 | 25 |
| Polyester resin B4 | 11.6 | 6,000 | 54 | 115 | 14 | 27 |
| Polyester resin B5 | 12.6 | 7,000 | 56 | 108 | 14 | 30 |

(Production of Resin Composition C)

(Production Example of Resin Composition C1)

600 parts of xylene, 500 parts of a low molecular-weight polypropylene 1 (softening point: 156° C., viscosity at 160° C.: 1,900 mPa·s, number-average molecular weight: 9,200), and 120 parts of a low molecular-weight polyethylene (softening point: 128° C., viscosity at 140° C.: 600 mPa·s, number-average molecular weight 3,800) were supplied to an autoclave reaction vessel equipped with a thermometer and a stirrer, and thoroughly dissolved. After the air in the vessel was replaced with nitrogen, a mixed solution containing 1,900 parts of styrene, 170 parts of acrylonitrile, 240 parts of monobutyl maleate, 78 parts of di-t-butylperoxyhexahydroterephthalate, and 455 parts of xylene was added dropwise to polymerize the resultant at 180° C. for 3 hours, and the resultant was held at 180° C. for minutes. Then, the solvent was removed from the resultant to obtain a resin composition C1.

Table 6 shows various physical properties of the obtained resin composition C1.

(Production Examples of Resin Compositions C2 to C5)

Resin compositions C2 to C5 were obtained in the same way as in the production example of the resin composition C1 except for using monomer species and blending amounts shown in Table 5. Table 6 shows various physical properties thereof. Note that a low molecular-weight polypropylene 2 has a softening point of 144° C., a viscosity at 160° C. of 150 mPa·a, and a number-average molecular weight of 3,300.

TABLE 6

| | Weight-average molecular weight Mw | Tg ° C. | Component | | SP value (cal/cm$^3$)$^{1/2}$ |
|---|---|---|---|---|---|
| Resin composition C1 | 10,500 | 84.2 | Polyolefin | Sd | 8.0 |
| | | | Vinyl-based resin | Se | 11.1 |
| Resin composition C2 | 9,000 | 59.5 | Polyolefin | Sd | 8.2 |
| | | | Vinyl-based resin | Se | 11.0 |
| Resin composition C3 | 8,060 | 57.5 | Polyolefin | Sd | 7.8 |
| | | | Vinyl-based resin | Se | 12.3 |
| Resin composition C4 | 6,500 | 50.5 | Polyolefin | Sd | — |
| | | | Vinyl-based resin | Se | 12.5 |
| Resin composition C5 | 15,000 | 90.2 | Polyolefin | Sd | 8.0 |
| | | | Vinyl-based resin | Se | — |

Example 1

| | |
|---|---|
| Polyester resin A1 | 20.0 parts by mass |
| Polyester resin B1 | 80.0 parts by mass |
| Resin composition C1 | 3.5 parts by mass |
| Carbon black | 5.0 parts by mass |
| Fischer-Tropsch wax (DSC peak temperature: 105° C.) | 5.5 parts by mass |
| Aluminum 3,5-di-t-butylsalate compound | 0.4 part by mass |

The above-mentioned materials were mixed with a Henschel mixer (FM-75 type, Mitsui Miike Machinery Co., Ltd.), and thereafter, the mixture was kneaded with a twin screw extruder (PCM-30 manufactured by Ikegai Corporation) under the conditions of a rotation number of 3.3 $s^{-1}$ and a kneading resin temperature of 140° C.

The kneaded material thus obtained was cooled and coarsely pulverized with a hammer mill to 1 mm or less to obtain a coarsely pulverized product. The coarsely pulverized product was finely pulverized with a mechanical pulverizer (T-250 manufactured by FREUND-TURBO CORPORATION). Further, the finely pulverized powder thus obtained was classified through use of a multidivision classifying

TABLE 5

| | Low molecular-weight polypropylene 1 | Low molecular-weight polypropylene 2 | Low molecular-weight polyethylene | Xylene | Vinyl-based resin: monomer configuration | | | | | |
|---|---|---|---|---|---|---|---|---|---|---|
| | | | | | Styrene | Monobutyl maleate | Acrylonitrile | Butyl acrylate | Di-t-butylperoxy hexahydroterephthalate | Xylene |
| Resin composition C1 | 500 parts | — | 120 parts | 600 parts | 1,900 parts | 240 parts | 170 parts | — | 78 parts | 455 parts |
| Resin composition C2 | — | 700 parts | — | 1,000 parts | 2,000 parts | — | 260 parts | 350 parts | — | 600 parts |
| Resin composition C3 | 250 parts | — | 100 parts | 350 parts | 900 parts | — | 50 parts | 130 parts | 40 parts | 150 parts |
| Resin composition C4 | — | — | — | — | 1,900 parts | 240 parts | 170 parts | — | 78 parts | 455 parts |
| Resin composition C5 | 500 parts | — | 120 parts | 600 parts | 1,900 parts | — | — | — | — | 100 parts |

machine using the Coanda effect to obtain negative friction electrification type toner particles having a weight-average particle diameter of 6.8 μm.

To 100 parts by mass of the obtained toner particles, 1.0 part by mass of titanium oxide fine particles having a primary average particle diameter of 50 nm subjected to surface treatment with 15 mass % of isobutyltrimethoxysilane and 0.8 part by mass of hydrophobic silica fine particles having a primary average particle diameter of 16 nm subjected to surface treatment with 20 mass % of hexamethyldisilazane, and the contents were mixed with a Henschel mixer (FM-75 manufactured by Mitsui Miike Machinery Co., Ltd.) to obtain a toner 1.

Table 8 shows various physical properties of the obtained toner 1.

In this example, a commercially available color laser printer "HP Color Laser Jet CP6015dn (manufactured by Hewlett-Packard Company)" was used as a machine to be used for evaluating the obtained toner 1. In the evaluating machine, the following evaluation was performed with the toner being changed to the toner 1 produced in this example.

(1) High-Speed Double-Sided Fixability

A commercially available color laser printer "HP Color Laser Jet CP6015dn (manufactured by Hewlett-Packard Company)" was remodeled so that the fixing temperature, fixing nip pressure, and process speed of a fixing device could be set arbitrarily.

A copy sheet (104.7 g/m$^2$ manufactured by Nippon Paper Industries Co., Ltd.) was used, and a black cartridge was used as a cartridge to be used for evaluation under an environment at a temperature of 23° C. and a relative humidity of 50%. That is, a product toner was removed from a commercially available black cartridge, and the inside of the cartridge was cleaned with an air blow. After that, 150 g of the toner 1 of the present invention were filled into the cartridge and evaluated. Note that each product toner was removed from each station of magenta, yellow, and cyan, and magenta, yellow, and cyan cartridges whose toner remaining amount detection mechanisms had been made invalid were inserted into the respective stations for evaluation.

After that, an unfixed solid black image was output so that the loading amount of a toner reached 0.6 mg/cm$^2$. The unfixed solid black image was fixed by setting the fixing temperature of a fixing unit at 150° C. and increasing a process speed in an increment of 20 mm/sec in a range of 300 mm/sec to 500 mm/sec. In this case, a double-sided printing mode was used. Further, the fixing nip surface pressure was set to 0.08 MPa. The surface of the obtained solid black image was rubbed with lens-cleaning paper under a load of about 100 g reciprocally five times, and the condition under which a density decrease ratio between the image densities before and after the rubbing became about 10% or less was defined as a process speed at which the image was able to be fixed. Then, the highest process speed satisfying a density decrease ratio of 10% or less was defined as a fixing speed. As a toner has a higher fixing speed, the toner is more excellent in low-temperature fixability (high-speed fixability). Table 8 shows evaluation results.

A: The fixing speed is 400 mm/sec or more.

B: The fixing speed is 350 mm/sec or more and less than 400 mm/sec.

C: The fixing speed is 300 mm/sec or more and less than 350 mm/sec.

D: The fixing speed is less than 300 mm/sec.

(2) Evaluation of Image after Conveyance Step (Glossiness Uniformity)

In the above-mentioned fixing test, an image was output under the conditions of a fixing temperature of the fixing unit of 150° C. and a fixing nip surface pressure of 0.08 MPa. A copy sheet: a cardboard (52.3 g/m$^2$ manufactured by Nippon Paper Industries Co., Ltd.) was used as paper (7).

Figure 4:
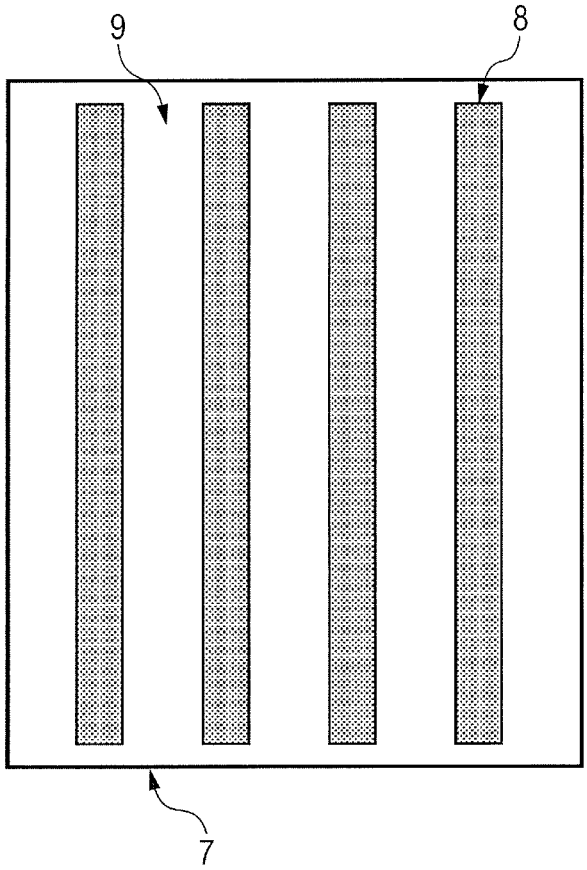
FIG. 4 is a diagram illustrating glossiness uniformity evaluation in the present invention.

A glossiness difference between a portion (8) of the obtained solid black image in contact with a conveyance roller and the remaining portion (9) not in contact with the conveyance roller was measured (see FIG. 4). The glossiness was measured through use of Handy Gloss Meter PG-1 (manufactured by Nippon Denshoku Industries Co., Ltd.). For measurement, a light projecting angle and a light receiving angle were respectively adjusted to 75°. The glossiness uniformity was evaluated by measuring the glossiness at 10 points on the output image, and determining a difference between the maximum value and minimum value of the glossiness based on the following standard. As a toner has a smaller glossiness difference, the toner is more excellent in changing its presence state rapidly.

Table 8 shows evaluation results.

A: The glossiness difference is less than 1.0.

B: The glossiness difference is 1.0 or more and less than 2.0 (good).

C: The glossiness difference is 2.0 or more and less than 3.0 (level which is allowable in the present invention).

D: The glossiness difference is 3.0 or more (level which is not allowable in the present invention).

(3) Evaluation of Image Compatible with Thin Paper

A commercially available color laser printer "HP Color Laser Jet CP6015dn (manufactured by Hewlett-Packard Company)" was remodeled so that the fixing temperature, fixing nip pressure, and process speed of a fixing device could be set arbitrarily.

A copy sheet: thin paper (52.3 g/m$^2$ manufactured by Nippon Paper Industries Co., Ltd.) was used, and a black cartridge was used as a cartridge to be used for evaluation under an environment at a temperature of 23° C. and a relative humidity of 50%. That is, a product toner was removed from a commercially available black cartridge, and the inside of the cartridge was cleaned with an air blow. After that, 150 g of the toner 1 of the present invention were filled into the cartridge and evaluated. Note that each product toner was removed from each station of magenta, yellow, and cyan, and magenta, yellow, and cyan cartridges whose toner remaining amount detection mechanisms had been made invalid were inserted into the respective stations for evaluation.

After that, an unfixed solid black image was output so that the loading amount of a toner reached 0.6 mg/cm$^2$. The unfixed solid black image was fixed by setting the fixing temperature of a fixing unit at 150° C. and increasing a process speed in an increment of 20 mm/sec in a range of 300 mm/sec to 500 mm/sec. In this case, a double-sided printing mode was used. Further, the fixing nip surface pressure was set to 0.08 MPa. The process speed was raised gradually, and the process speed at which the image was able to be continuously fixed on 50 sheets without paper jam was defined as a fixing speed. As a toner having a higher fixing speed, the toner is more excellent in low-temperature fixability (high-speed fixability) and in changing its presence state rapidly.

Table 8 shows evaluation results.

A: The fixing speed is 400 mm/sec or more.

B: The fixing speed is 350 mm/sec or more and less than 400 mm/sec.

C: The fixing speed is 300 mm/sec or more and less than 350 mm/sec.

D: The fixing speed is 250 mm/sec or more and less than 300 mm/sec.

E: The fixing speed is less than 250 mm/sec.

(4) Evaluation of Image Stored Under Long-Term Severe Condition (Evaluation of Curling Property)

In the above-mentioned fixing test, the unfixed solid black image was fixed under conditions of a fixing temperature of 150° C., a fixing nip pressure of 0.25 MPa, and a process speed of 200 mm/sec. The solid black image thus obtained was left to stand in an environment test chamber at a temperature of 40° C. and a relative humidity of 50% for 30 days. After the solid black image was left to stand, the solid black image was put on a flat platform, and one side of the paper in a longitudinal direction was fixed with a tape. In this case, an angle formed by the flat platform and the paper was measured when the other side of the paper was curled, and thus a curling property was evaluated. It can be said that as the angle is smaller, the long-term storage property is more satisfactory. Table 8 shows evaluation results.

A: The angle is less than 10°.

B: The angle is 10° or more and less than 20°.

C: The angle is 20° or more and less than 30°.

D: The angle is 30° or more and less than 40°.

E: The angle is 40° or more.

Accordingly, in Example 1, a satisfactory result was obtained in any evaluation.

Examples 2 to 20

Toners 2 to 20 were obtained in the same way as in Example 1 except for using the formulation of Table 7. Further, the same evaluations as those of Example 1 were performed. Table 8 shows the obtained results.

Comparative Examples 1 to 6

Toners 21 to 26 were obtained in the same way as in Example 1 except for using the formulation of Table 7. Further, the same evaluations as those of Example 1 were performed. Table 8 shows the obtained results.

TABLE 7

| | | Polyester resin A | Polyester resin B | Resin composition C | Mass ratio A:B:C |
|---|---|---|---|---|---|
| Example 1 | Toner 1 | A1 | B1 | C1 | 20:80:3.5 |
| Example 2 | Toner 2 | A2 | B1 | C1 | 20:80:3.5 |
| Example 3 | Toner 3 | A-3 | B1 | C1 | 20:80:3.5 |
| Example 4 | Toner 4 | A11 | B1 | C1 | 20:80:3.5 |
| Example 5 | Toner 5 | A12 | B2 | C1 | 20:80:3.5 |
| Example 6 | Toner 6 | A4 | B1 | C1 | 20:80:3.5 |
| Example 7 | Toner 7 | A5 | B3 | C1 | 20:80:3.5 |
| Example 8 | Toner 8 | A1 | B1 | C1 | 20:80:3.5 |
| Example 9 | Toner 9 | A6 | B1 | C1 | 20:80:3.5 |
| Example 10 | Toner 10 | A4 | B1 | C1 | 20:80:3.5 |
| Example 11 | Toner 11 | A4 | B1 | C1 | 8:92:2.5 |
| Example 12 | Toner 12 | A4 | B1 | C1 | 36:64:1.0 |
| Example 13 | Toner 13 | A6 | B1 | C1 | 4:96:3.5 |
| Example 14 | Toner 14 | A6 | B1 | C1 | 42:58:3.5 |
| Example 15 | Toner 15 | A14 | B3 | C1 | 20:80:3.5 |
| Example 16 | Toner 16 | A4 | B1 | C2 | 20:80:3.5 |
| Example 17 | Toner 17 | A5 | B3 | C3 | 20:80:3.5 |
| Example 18 | Toner 18 | A1 | B3 | C1 | 20:80:3.5 |
| Example 19 | Toner 19 | A4 | B5 | C1 | 20:80:3.5 |
| Comparative Example 1 | Toner 20 | A12 | B3 | — | 20:80:0 |
| Comparative Example 2 | Toner 21 | A7 | B4 | C1 | 20:80:3.5 |
| Comparative Example 3 | Toner 22 | A9 | B2 | C1 | 20:80:3.5 |
| Comparative Example 4 | Toner 23 | A8 | B3 | C1 | 20:80:3.5 |
| Comparative Example 5 | Toner 24 | A12 | B1 | C4 | 20:80:3.5 |
| Comparative Example 6 | Toner 25 | A10 | B3 | C5 | 5:95:3.5 |
| Comparative Example 7 | Toner 26 | A13 | B4 | C1 | 20:80:3.5 |

TABLE 8

| | | High-speed double-sided fixability rank/(mm/sec) | | Evaluation of image after conveyance step | | Evaluation of image compatible with thin paper | | Evaluation of image stored under long-term severe condition | |
|---|---|---|---|---|---|---|---|---|---|
| Example 1 | Toner 1 | A | 400 | A | 0.2 | A | 400 | A | 0 |
| Example 2 | Toner 2 | A | 400 | A | 0.2 | A | 400 | A | 2 |
| Example 3 | Toner 3 | A | 400 | A | 0.4 | A | 400 | A | 4 |
| Example 4 | Toner 4 | A | 400 | A | 0.4 | A | 400 | A | 4 |
| Example 5 | Toner 5 | A | 400 | A | 0.2 | A | 400 | B | 12 |
| Example 6 | Toner 6 | B | 380 | A | 0.6 | B | 360 | A | 6 |
| Example 7 | Toner 7 | A | 400 | A | 0.4 | A | 400 | B | 12 |
| Example 8 | Toner 8 | A | 400 | A | 0.2 | A | 400 | B | 12 |
| Example 9 | Toner 9 | A | 400 | B | 1.2 | B | 360 | A | 8 |
| Example 10 | Toner 10 | A | 400 | A | 0.4 | B | 360 | A | 6 |
| Example 11 | Toner 11 | B | 360 | A | 0.6 | A | 400 | A | 6 |
| Example 12 | Toner 12 | A | 400 | B | 1.2 | B | 360 | B | 12 |
| Example 13 | Toner 13 | C | 340 | A | 0.6 | A | 400 | A | 8 |
| Example 14 | Toner 14 | A | 400 | B | 1.4 | C | 320 | C | 22 |
| Example 15 | Toner 15 | C | 320 | A | 0.4 | B | 360 | B | 14 |
| Example 16 | Toner 16 | A | 400 | B | 1.6 | C | 320 | C | 20 |
| Example 17 | Toner 17 | A | 400 | B | 1.8 | C | 320 | C | 24 |
| Example 18 | Toner 18 | A | 400 | A | 0.8 | A | 400 | C | 26 |
| Example 19 | Toner 19 | A | 400 | B | 1.6 | C | 320 | C | 26 |
| Comparative Example 1 | Toner 20 | B | 360 | C | 2 | C | 300 | C | 26 |
| Comparative Example 2 | Toner 21 | B | 360 | C | 2.4 | C | 300 | C | 28 |

TABLE 8-continued

| | | High-speed double-sided fixability rank/(mm/sec) | | Evaluation of image after conveyance step | | Evaluation of image compatible with thin paper | | Evaluation of image stored under long-term severe condition | |
|---|---|---|---|---|---|---|---|---|---|
| Comparative Example 3 | Toner 22 | B | 380 | C | 2.6 | C | 300 | D | 34 |
| Comparative Example 4 | Toner 23 | C | 340 | C | 2.4 | C | 300 | D | 36 |
| Comparative Example 5 | Toner 24 | B | 360 | D | 3.2 | D | 260 | E | 42 |
| Comparative Example 6 | Toner 25 | B | 360 | D | 3.4 | E | 200 | E | 46 |
| Comparative Example 7 | Toner 26 | B | 360 | C | 2.6 | C | 300 | C | 28 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-141035, filed Jun. 22, 2012, which is hereby incorporated by reference herein in its entirety.

What is claimed is:

1. A toner, comprising toner particles, each of which contains a polyester resin A, a polyester resin B, a coloring agent, and a resin composition C, wherein:

(1) the polyester resin A comprises a polyester part including a moiety capable of forming a crystalline structure and a crystal nucleating agent part, the crystal nucleating agent part being bonded to an end of the polyester part;

(2) the polyester resin B comprises a resin free of a moiety capable of forming a crystalline structure; and (3) the resin composition C comprises a resin composition including a vinyl-based resin component and a polyolefin resin component bonded to each other, and wherein Sa, Sb, Sc, Sd, and Se satisfy the following relationships:

$$9.0<Sa<12.5$$

$$0<|Sc-Sd|<1.8$$

$$2.6<Se-Sd<4.6$$

$$-2.0<Sb-Sa<0.8$$

where the Sa $((cal/cm^3)^{1/2})$ represents an SP value of the polyester part in the polyester resin A, the Sb $((cal/cm^3)^{1/2})$ represents an SP value of the polyester resin B, the Sc $((cal/cm^3)^{1/2})$ represents an SP value of the crystal nucleating agent part in the polyester resin A, the Sd $((cal/cm^3)^{1/2})$ represents an SP value of the polyolefin resin component, and the Se $((cal/cm^3)^{1/2})$ represents an SP value of the vinyl-based resin component.

2. The toner according to claim 1, wherein the Sa, the Sc, and the Sd satisfy the following relationship $$|Sd-Sc|<|Sd-Sa|.$$

3. The toner according to claim 1, wherein a mass ratio between the polyester resin A and the polyester resin B is 5:95 to 40:60.

4. The toner according to claim 1, wherein the crystal nucleating agent part is formed by bonding at least one compound selected from the group consisting of an aliphatic carboxylic acid having 10 or more and 30 or less carbon atoms and an aliphatic alcohol having 10 or more and 30 or less carbon atoms, to the end of the polyester part.

5. The toner according to claim 1, wherein the Sb is 10.0 or more and 12.5 or less.

* * * * *